US005752768A

United States Patent [19]

Assh

[11] Patent Number: 5,752,768

[45] Date of Patent: May 19, 1998

[54] SYSTEM FOR CONTROL OF THE CONDITION OF MIXED CONCRETE

[76] Inventor: Daniel Assh, 360 Franquet, Suite 10, Ste-Foy, Quebec, Canada, G1P 4N9

[21] Appl. No.: 117,034

[22] PCT Filed: Mar. 4, 1992

[86] PCT No.: PCT/CA92/00092

§ 371 Date: Sep. 3, 1993

§ 102(e) Date: Jan. 24, 1994

[87] PCT Pub. No.: WO92/15437

PCT Pub. Date: Sep. 17, 1992

[30] Foreign Application Priority Data

Mar. 4, 1991 [CA] Canada ..... 2037511

[51] Int. Cl.[6] ..... B28C 5/06; B01F 9/02

[52] U.S. Cl. ..... 366/3; 366/60

[58] Field of Search ..... 366/60, 61, 62, 366/63, 3, 10, 11, 44, 40, 29, 2; 377/15

[56] References Cited

U.S. PATENT DOCUMENTS

| | | | |
|---|---|---|---|
| 1,800,666 | 4/1931 | Shafer | 366/42 |
| 2,645,947 | 7/1953 | Lendved | 366/60 |
| 2,661,935 | 12/1953 | Willard | 366/60 |
| 3,160,398 | 12/1964 | Green | 366/61 |
| 3,460,812 | 8/1969 | Kaufman | 366/60 |
| 3,496,343 | 2/1970 | Johanson | 377/15 |
| 3,548,165 | 12/1970 | Linnenkamp | 377/15 |
| 3,582,969 | 6/1971 | Kinney | 377/15 |
| 3,627,281 | 12/1971 | Peterson | 366/60 |
| 4,114,193 | 9/1978 | Hudelmaier | 366/34 |
| 4,403,866 | 9/1983 | Falcoff | 366/142 |
| 4,547,660 | 10/1985 | Whitson | 366/142 |

*Primary Examiner*—Robert W. Jenkins

[57] ABSTRACT

A mobile cement mixer is provided with a programmed controller that automatically causes the mixing of concrete to follow a predefined mixing regime that is interruptable by an operator but will resume the mixing regime at the appropriate stage.

51 Claims, 8 Drawing Sheets

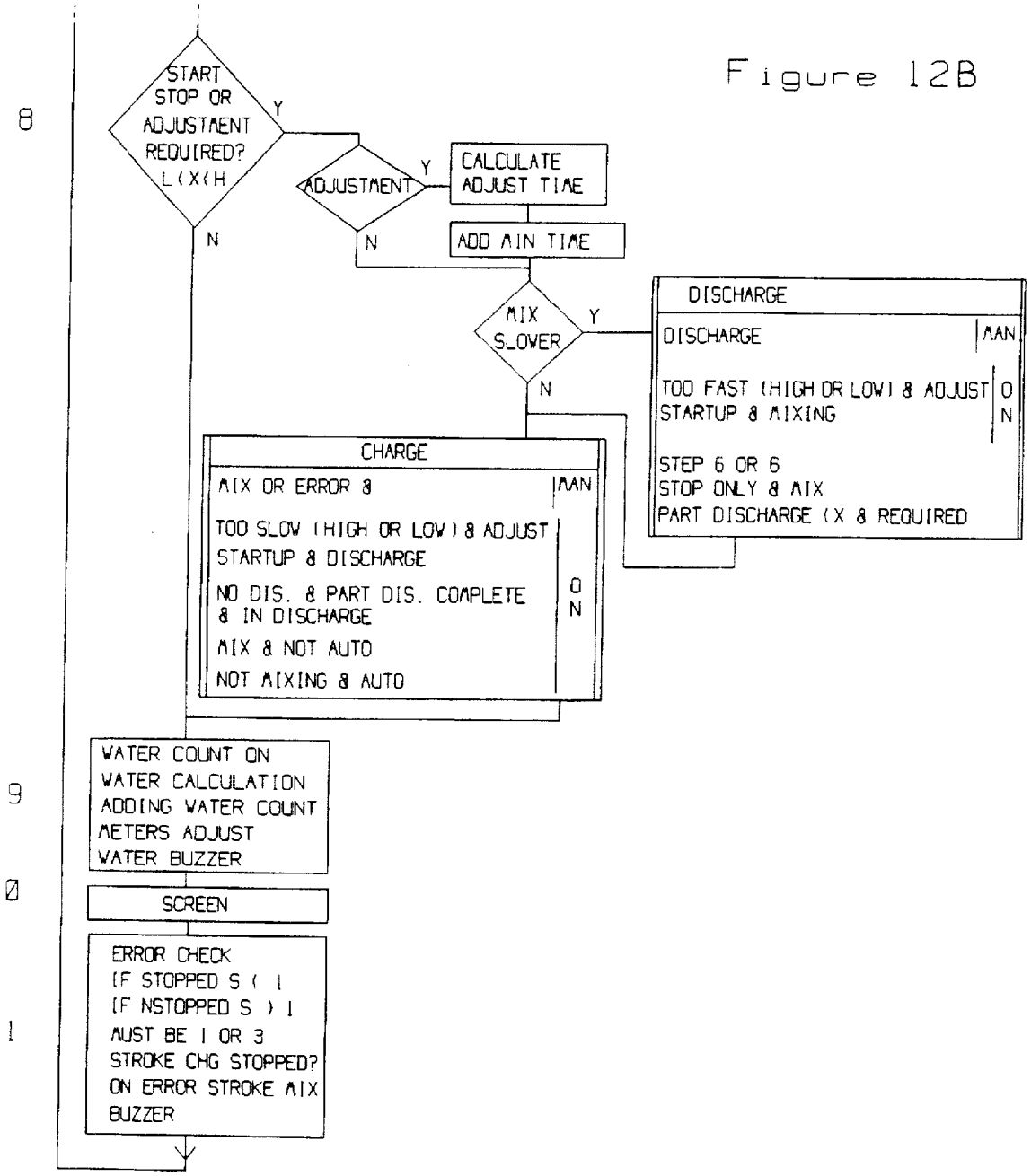
Figure 12B
START STOP OR ADJUSTMENT REQUIRED? L<X<H
Y
N
ADJUSTMENT
Y
N
CALCULATE ADJUST TIME
ADD MIN TIME
MIX SLOWER
Y
N
DISCHARGE
DISCHARGE
MAN
TOO FAST (HIGH OR LOW) & ADJUST
STARTUP & MIXING
ON
STEP 6 OR 6
STOP ONLY & MIX
PART DISCHARGE (X & REQUIRED
CHARGE
MIX OR ERROR &
MAN
TOO SLOW (HIGH OR LOW) & ADJUST
STARTUP & DISCHARGE
NO DIS. & PART DIS. COMPLETE
& IN DISCHARGE
MIX & NOT AUTO
NOT MIXING & AUTO
ON
WATER COUNT ON
WATER CALCULATION
ADDING WATER COUNT
METERS ADJUST
WATER BUZZER
SCREEN
ERROR CHECK
IF STOPPED S < 1
IF NSTOPPED S > 1
MUST BE 1 OR 3
STROKE CHG STOPPED?
ON ERROR STROKE MIX
BUZZER

SYSTEM FOR CONTROL OF THE CONDITION OF MIXED CONCRETE

FIELD OF THE INVENTION

This invention relates to mobile cement mixers and means for controlling the mixing regimen of concrete within such mixers. More particularly it relates to improved means for ensuring that concrete delivered by such mixers is of optimal strength and consistency, and includes means for allowing for the necessity of adjusting its consistency or "slump" from time to time.

BACKGROUND TO THE INVENTION

The quality of concrete is significantly affected by the manner in which it is mixed, and the amount of water added. These factors critically govern the strength of concrete that can potentially be achieved, and the strength of concrete greatly affects it marketability. If strengths over certain thresholds can reliably be assured, concrete can compete economically with steel for large structures.

Concrete specifications for concrete delivered to a job site typically require that the concrete on arrival be guaranteed to achieve a minimum specified strength, 99% of the time. When the variability of concrete strength is large, suppliers must increase the content of portland cement within the concrete sufficiently to statistically ensure that they achieve this result. By narrowing the variability of concrete quality, suppliers would be able, at considerable savings, to reduce the content of portland cement without risking, statistically, failure to meet the required strength criteria. One way of reducing the variability of concrete strength is to control carefully the mixing regime or cycles that the concrete passes through before being placed in position at the job site.

It is now generally customary to have concrete delivered to construction sites in vehicles that have a concrete mixing capacity. Such vehicles are loaded with the correct proportions of sand, stone, cement and sometimes with water at the home-base or batching plant for the mixing trucks. If water is not added at the batch plant, the vehicle is said to be carrying a "dry batch" as opposed to a regular batch that includes water. In the case of a dry batch, the water is eventually added by the driver from the standard water reservoir carried on the truck.

After being charged with all the necessary ingredients, the mixing cycle can commence. In the case of a regular batch containing water this is usually effected before departure, while the vehicle is standing in the batch plant yard. In the case of a dry batch some agitation of the dry mix may occur before or during transit, but mixing proper commences when the vehicle is near the job site and water is added to the dry batch.

The strength of concrete when set, and its workability at the job site, are critically dependent on the mixing regime that is followed. The Truck Mixer Manufacturers' Bureau of the United States of America (TMMB) provides the following recommended criteria for the mixing of a full load of concrete in order to ensure an even consistency and obtain satisfactory strength without "over-working" the concrete:

1. mixing turns: 70 to 100 turns at 6 to 18 rpm
2. on addition of further water, a minimum of 30 additional turns at mixing speed
3. holding or "agitation" turns, not over 6 rpm and not to exceed 300 turns in total, including mixing turns.

These figures are premised on a typical North American mobile mixer having a 6 to 15 cubic yard capacity, a ten foot or so maximum diameter inclined drum with a series of spirally inclined mixing fins on the interior surface.

The foregoing criteria are examples of recommended limits for the target mixing regime for concrete, based on full loads. However, no standards exist that address mixing requirements when the load is less than full.

Another consideration that is not addressed by present standards is that it is very important, once proper mixing is completed, to maintain a minimum degree of further agitation sufficient to prevent separation, (preferably around 1½–2½ rpm), but no higher than necessary as this will accelerate the setting of the concrete by over-working it.

These are examples of issues arising from the mixing regime to which concrete may be subjected that significantly affect concrete quality. For the great proportion of deliveries at present, the driver is personally responsible for controlling the rate and duration of rotation of the drum. It is desirable to remove the greater part of this responsibility from the driver in order to increase the reliability and consistency of concrete that is being delivered by mobile cement mixers.

Accordingly, one of the objects of this invention is to provide an automated system for controlling the mixing regime for concrete that is being transported in a mobile concrete mixer, through its various stages.

Mixing Speed

It is presently customary to drive the rotary motion of the mixing drum by means of a bi-directional hydraulic motor. Pressurized fluid for the activation of this motor is obtained from a variable-stroke hydraulic pump that is usually positioned on the chassis at the front of the vehicle. This pump is, in turn, driven by the vehicle's own engine.

A typical variable-stroke hydraulic pump in use is one that relies on a swash-plate to control the degree of stroke in either direction, corresponding to mixing or discharging concrete. The orientation of the swash plate in such systems is governed by an arm or lever. This lever may be designated as the "stroke control arm". Other configurations may exist for controlling the volume of hydraulic fluid being pumped, but their action may be considered as being analogous.

It is now customary to provide in the vehicle cab a remote-control positioning switch which allows the driver to displace the stroke control arm progressively in either the mixing or discharge directions. By this means the stroke control arm may be advanced by the driver in repeated steps to provide increasing rates of flow of hydraulic fluid for turning the mixing drum at various speeds in either of the two directions.

While the above arrangement has the advantage of providing a fully variable means for controlling drum rotations, certain inconveniences and disadvantages are also associated with this arrangement.

In a manual system the driver is normally responsible for controlling the rate of rotation of the drum. This is done manually by controlling the degree of stroke on the hydraulic pump. Since the hydraulic pump operates off the vehicle's motor, the rotational input to the pump will be dictated by the engine speed.

Once a full charge of ingredients has been placed in the mixing drum, the driver will customarily set the stroke on the pump so as to obtain the maximum rate of drum rotations within the recommended mixing range. This is done while vehicle is sitting at the batch plant site as it is dangerous to drive the vehicle while the drum is rotating at high speed.

On departure, the stroke will be set to merely agitate the concrete. As long as the driver's initial setting remains unchanged, unless a speed governor for the mixing drum is employed, the rate of rotation of the drum will depend on the vehicle engine's rpm. In stop-and-go traffic where the vehicle must sit with its engine idling, the driver may set the rotational rate of the drum at a level which, once higher speeds are achieved, transfers the drum rpm into a range above the preferred agitation range, and possibly into the mixing regime. This is damaging for the concrete as it leads to over-working.

In U.S. Pat. No. 3,627,281 to Peterson, a proposal is described for a control system, to be mounted on a mixing vehicle, which is capable of:

(1) indicating if mixing speed is within a given range;

(2) counting revolutions within that range;

(3) automatically effecting a reduction in the mixer speed to agitation speed when a predetermined number of turns within the mixing range has been achieved; and (4) recording the total turns accumulated. Peterson effects these results through the use of time-delay capacitive circuits and relays. His invention, therefore, provides one method for relieving drivers from some of the responsibilities of controlling the mixing regime for the concrete they are transporting.

However, Peterson automatically moves the stroke control arm from a preset discrete mixing position to a preset agitation position, both being set manually by the driver. Consequently, in either mode the mixing drum speed always varies with the vehicle engine speed.

Also Peterson's system allows the driver to choose both mixing and agitation speeds, and to discharge concrete at any time, whether or not mixing is complete.

The present invention has as one of its object the avoidance of these deficiencies by allowing the rotational speed of the drum to be independent of vehicle engine speed, and the provision of further improvements in the control of the rotational speed of mixing drums.

One of the further objects of this invention is to provide an interruptible mixing drum rotational speed control system that will cause the drum to rotate at predetermined speeds and to follow a preset mixing regimes that are interruptible but otherwise are not controllable by the driver, irrespective of the speed of the vehicle's engine, according to the stage that the concrete has reached in its mixing regime.

Air Entrainment

It is now well established that the entrainment of air in concrete increases its workability with far less damage to its ultimate compressive strength than would occur through the addition of water. To enhance air entrainment, chemicals and other ingredients are now commonly added to concrete mixes on charging.

It has also been determined that while a high initial mixing speed is desirable in order to introduce air into concrete, both an excessively high mixing speed and the continued maintenance of a high mixing speed can be deleterious by breaking air cells and releasing entrained air.

It is therefore an object of this invention to provide a mixing regime for concrete that will maximize he degree to which air is entrained therein.

Prevention of Premature Discharqe

One of the features of the invention is the prevention of premature discharge of concrete, prior to the completion of the appropriate mixing cycle. The appropriate mixing cycle may vary according to the following stages or conditions:

(1) initial mixing;

(2) mixing following the addition of further ingredients such as water or plasticizers; and (3) mixing following a period when the drum has been at rest, or in agitation for an extended period of time.

The preferred mixing regime to be followed under the above circumstances may also vary according to the size of the load remaining in the mixer.

The automatic prevention of premature discharge will ensure that the concrete must necessarily have been mixed properly before it is released for installation at the job site.

Water Addition—Mixing Requirements

When the concrete is over-mixed, either through excessive high speed turns or a long delay before delivery, the concrete is accelerated or advanced in its setting process, such that the concrete becomes too stiff for ready workability. Over-mixing also consumes valuable permissible turns and, with the passage of time, may cause the maximum number of permissible turns to be exceeded prior to discharge.

The remedy for overly stiffened concrete, if this condition does occur, is to add more water. This step alone reduces the quality of the concrete. An equally serious concern is that upon the addition of further water, a fresh mixing regime is necessary in order to ensure optimum concrete quality. The standards of the Truck Mixer Manufacturing Bureau of Maryland have recommended that when water is added to a full load of concrete that a minimum of 30 further mixing turns take place.

Under the pressure of a tight delivery schedule, the driver and workers at the job site may be tempted to skimp on this further concrete-processing step, especially if the job-site inspector has already "accepted" the load and no further inspections are likely. The result is that under-mixing can seriously degrade the quality and/or consistency of the concrete, in terms of its compressive strength and durability. And where an inspector is present, it can mean rejection of the load.

A further object of the invention is, therefore, to ensure that adequate further mixing occurs upon the addition of water or other ingredients to the concrete. This is achieved by making provision to prevent the premature discharging of concrete when further materials are added to a load of concrete, after the initial mixing process has been concluded.

Water Addition—Slump Adjustment

It typically is necessary to add water after the initial mixing cycle has commenced, or has been concluded, in order to adjust the slump of the concrete. If left to the total discretion of the driver, the addition of water to increase the degree of slump of concrete (and therefore its workability) may be overused and abused. Whenever, further water is added to concrete, it is done so at the cost of weakening its ultimate compressive strength.

It is therefore a further object of this invention to provide:

(1) a means by which the anticipated effect of added water on slump is presented to the operator as water is being added; and (2) a record of any addition of water occurring after the mixer has been initially charged.

Slump and Load Estimating

It is known that the general stiffness or "slump" of the concrete can be detected by monitoring the level of hydraulic pressure required by the hydraulic motor to rotate the drum at elevated speeds corresponding approximately to the maximum vehicle motor speed. After mixing is complete, a relatively stable average pressure will initially be established in the hydraulic fluid lines. With the drum set to rotate at agitation speed, as time passes the concrete will stiffen. The stiffening of the concrete will be apparent from the rising of the hydraulic pressure necessary to maintain the same rpm. This is analogous to measuring the torque developed on the motor.

By conducting calibration comparisons against standard "slump" tests, the slump of a known quantity of concrete can be determined from the pressure in the hydraulic motor circuit. Existing systems, however, are premised on establishing that a predetermined quantity or volume of concrete is present within the mixing drum. Such systems rely upon the fact that the load placed in the mixer on charging is precisely known.

The hydraulic pressure level necessary in the hydraulic motor circuit to turn the drum at a given speed will depend, not only on the stiffness or slump of the concrete, but also the amount of concrete in the drum. As concrete is dispensed from the mixer, the existing procedures for estimating the slump condition of the remaining concrete no longer apply.

Accordingly, it is a further object of this invention to provide a means for estimating the quantity of concrete in a mixing drum after a partial discharge has occurred. From such information it is intended to provide a means by which the slump of the remaining concrete can be estimated.

These same means for determining the amount of concrete remaining in a drum after partial discharge has occurred may also be applied to modifying the mixing regime in cases where re-mixing of a partial or reduced load is required after further water or other ingredients have been added.

Determining Load by Direct Measurement

The load in a concrete drum may be determined by placing strain gauges or load cells at the support points where the mixing drum is carried by the vehicle frame. If such measuring devices are placed at all support points, the load can be measured directly.

On a typical inclined drum, the discharge end of the drum is mounted on a pair or more of symmetrically disposed rollers, mounted relatively highly upon the vehicle frame at the rear. This is an inconvenient location for load measuring devices to be installed. Further such devices, and the control system to extract a load measurement, carry a cost proportional to the number of devices utilized.

It would be convenient to reduce the number of load measuring devices, and to avoid the necessity of installing such devices at the upper, rear support bearings.

Accordingly, a further object of the invention is to provide a means by which the load of concrete in an inclined mixing drum may be determined directly by measuring only the load at the lower, forward end of the drum.

Measuring and Recording Drum Rotational Speed In addition to providing a system to control the mixing regime of concrete it is also desirable to provide a means for recording the rotation of the mixing drum. Such records can verify whether the automated control system has operated correctly, and can detect attempts to subvert the system. In order to record the rotation of the drum, the rotational speed of the drum must first be detected.

A known means for recording the rate of revolutions of the mixing drum is through the use, in combination, of a clock system and a pick-up that senses the passage of detectable protrusions, cut-out's, discontinuities or equivalent markers mounted on the circumference of the drum or on rotating elements of the drive train. Conveniently, speed is measured by determining the distance travelled in a given pre-set time. In the case of measuring drum rpm on cement mixers, proposals have been made for such a procedure, vis:

$$RPM = \frac{\text{\# markers measured}}{\text{\# markers in a full turn}} \quad \frac{\text{pre-set}}{\text{time interval}}$$

In all such cases the passage of markers is counted while a clock cycle is counting-off the pre-set time interval. Such a procedure cannot provide a precise measurement of rpm due to the fact that uncertainty exists at the end of the preset period arising from failure to measure drum-travel since passage of the last marker was recorded.

Accordingly, one object of this invention is to provide an improved means of more accurately measuring drum rotational speed on a concrete mixer.

Recording Drum Rotational History

Once a drum-rotation detection system is in place, it is convenient to record the entire history of treatment of the concrete over time, from loading to final discharge. Such a record is useful to detect departures from normal delivery patterns, as where a driver makes an unauthorized stop whereat drum rotation ceases; or where water is surreptitiously added to conceal such a stop.

The mere procedure of making a permanent record of the mixing regime for each load of concrete will have a salutary effect on the discipline of both vehicle operators and job-site foremen. It will also provide customers with reassurance that the automatic mixing control system has performed correctly.

It is accordingly a further object of this invention to provide a means for digitally recording the rotational history of a mixing drum over time. It is particularly an object to record such history with reference to the direction in which the drum is turning, and with reference to the periods of time during which the drum has been actually stopped and not turning at all.

Recording the Addition of Water

The same considerations that make it desirable to produce a record of the drum rotational history applies to the addition of water from the vehicle-mounted water reservoir.

Accordingly, another object of the invention is to provide such a record of water addition, in terms of the quantity of water added to the load, and in terms of the stage at which such water has been added.

Review of the Prior Art

The problems associated with controlling the mixing associated with concrete have been addressed in a number of prior art references, vis:

| | |
|---|---|
| U.S. | 4,547,660 to Whitson |
| | 4,403,867 to Duke |
| | 4,114,193 to Hudelmaier |
| | 3,627,281 to Peterson |
| | 3,582,969 to Kinney |
| | 3,548,165 to Linnenkamp |
| | 3,496,343 to Johnanson |
| | 3,460,812 to Kaufman |
| | 1,800,666 to Shafer |

The prior teaching by Kaufman provides for a preset timing cycle during which a solenoid pulls and holds the engine throttle a preset distance necessary to obtain the correct drum rotation speed. This solves the problem of obtaining a standard mix cycle at a pre-determined speed using the vehicle engine as the prime power source, but requires adjustment for each vehicle and adjustment thereafter due to wear. Another problem with Kaufman's technique is that the system requires the vehicle to be immobilized prior to activation of his control system, does not provide protection from accidental activation while in motion, and does not accommodate varying volumes of concrete.

Johanson, Linnenkamp, and Kinney teach counting the number of total revolutions as well as the number of revolutions at an acceptable mixing speed to provide a record of the mixing history of a load of concrete. One problem with these references is that a reading is taken based on a preset time interval and only full revolutions are counted. Therefore, part-turns which are acceptable (e.g. as would occur in stop and go traffic) would not be counted in these prior art references. Therefore, this results in over-mixing. As well, any discharge revolutions which should not be counted are counted. (Discharge turns do not count because no agitation or mixing takes place while discharging.) Discharge turns are counted because these references do not discriminate between the directions of rotation of the drum.

Kinney, in particular, shows a device using a magnetically actuatable switch housed in a protective case to determine both total revolutions and revolutions in the correct speed range to be counted as mix revolutions. However, the Kinney counter will be erroneous because there is no detection of the drum direction.

Kinney teaches that drum rotational speed can be measured by using two switches in close proximity to each other so that the time that a marker on the drum takes to pass between the two switches can determine acceptable speeds. No reference is made as to the direction in which the drum is turning. Therefore, if the drum is turning in the discharge direction the apparent elapsed time would, incorrectly, still be recorded as a mixing turn, albeit that the measured time delay between excitation of the two switches would be too long to accurately reflect rotational speed.

The second problem with these prior art counters concerns the reset function. A reset function provides a means by which drivers may subvert the recordal system. Johanson solves this problem by not having a means by which the driver may reset of the counter, but requires the drivers/inspectors to note the values of both the total and mix revolutions at the beginning of each load. Consequently, this would require the driver to calculate the required mix value for a complete mix and, therefore, add to the risk of error. Further, there is no determination of whether the counter is operating properly.

Linnenkamp provides 2 buttons that selectively reset their respective counters. This makes falsification easy. Kinney mentions the use of anti-tamper devices for the reset buttons, thus recognizing the problem. But a satisfactory solution is not provided. Peterson teaches how to determine the total number of revolutions, and also a way of determining the number of mixing turns which fall between acceptable higher, and lower, speed limits. Peterson further automatically initiates a change from mixing speed to the slow, agitating speed when a predetermined number of counted revolutions are completed. This is accomplished through a servomechanism connected to the hydraulic pump. The servomechanism includes a follower potentiometer—a voltage comparator—that is connected to the pump stroke actuator. The servomechanism operates by selectively energizing a motor, depending on the sign from the voltage comparator, to adjust the pump stroke actuator to zero in on a predetermined amount of strokes. Peterson also teaches that one may use a remote relay to override the system and then use an additional potentiometer for remote adjustments of the drum speed.

Peterson has two main problems. Firstly he pre-sets an adjustable stroke for high and low speeds. Because the engine rpm can vary by 300% the speed of the drum can vary by 300%. Also for low speed agitation the intrinsic losses in the pump and motor could stop the drum (which is very adverse to the concrete) at idle engine speeds. Conversely if this problem were solved by using a high agitation setting on start-up, then the speed of agitation at highway speeds could be excessive.

Further deficiencies in Peterson are that there is no protection against premature discharge of the concrete and the resetting the counters is done manually, allowing for easy falsification of the readings.

Hudelmaier teaches the use of a two-part system by which mixing instructions for the first part of the mixing regime are down-loaded from the plant into the truck while the truck is standing at the batch plant. Hudelmaier also provides for loading and mixing to occur at preselected speeds and prevents premature departure until the initial mixing cycle is complete. This latter feature interferes with the high speed loading of trucks at the batch plant. Another feature of Hudelmaier is to prevent premature discharge of concrete by physically locking-out the discharge portion of the stroking mechanism until mixing is complete. This is proposed for use where mixing occurs at the job site. The addition of water at this stage can also be controlled by a time switch which holds open an electrically actuated water valve for a set period of time. Alternately, the time that the switch is open can be used to measure the quantity of water being added to a load as this is occurring.

Duke (U.S. Pat. No. 4,403,867) demonstrates a method of mixing for a predetermined number of revolutions without any other control on the speed other than by design.

Whitson (U.S. Pat. No. 4,547,660) illustrates a system in which an alarm sounds when the required number of residual counts at mixing speed equals zero.

In all these control systems the concrete is left in the hands of the driver once initial mixing has occurred. There is no control after initial mixing has been completed. No adjustment is made for the amount of concrete loaded or for the amount of concrete present after partial discharge has occurred. None have a means to allow the driver to stop the execution of the mixing regime and then automatically resume operation thereafter.

Hudelmaier has the particular problem in that, since his system operates by controlling engine speed, this requires that all mixing must be done with the vehicle stopped; or the pump must be run off a separate motor.

None show a method of determining the direction of drum rotation or using the last activation command to determine stroke direction. None automatically activate the mix mode upon addition of water. None use the control system to allow for measurement of slump and in turn the adjustment thereof. None use the drum revolution counter to provide a journal of events.

It is against this background of practices in the industry and proposals made in the prior art that the invention described hereafter may be appreciated.

The invention in its general form will first be described, and then its implementation in terms of specific embodiments will be detailed with reference to the drawings following hereafter. These embodiments are intended to demonstrate the principle of the invention, and the manner of its implementation. The invention will then be further described, and defined, in each of the individual claims which conclude this Specification.

SUMMARY OF THE INVENTION

In accordance with the invention an electronic controller is provided which will automatically, while allowing partial driver intervention, step a concrete mixer through the various stages of a predetermined, multi-stage mixing regime. Any motion in the mix direction for over an initial delay period will transfer control of drum rotation of the controller. The controller prevents concrete from being discharged prior to the completion of the appropriate mixing cycle, while allowing driver intervention to suspend mixing at any time. The controller is re-programmable, permitting the ready modification of the mixing regime that it imposes.

In accordance with one aspect of the invention the rotational force for turning the drum is derived from the vehicle engine through a hydraulic pump without use of a separate engine, but the speed of rotation of the drum, when turning in the mixing regime, is maintained substantially at a predetermined level by the controller, to the limit of the pump's capacity, that is independent of vehicle engine speed.

In accordance with one variation of the invention the entrainment of air within a load of concrete may be maximized by:

(1) mixing the concrete initially at a first elevated mixing speed which causes a substantial quantity of air to become entrained in such concrete; and (2) continuing the mixing of the concrete to a conclusion at a second, reduced mixing speed which minimizes the extent to which previously entrained air is released from the concrete.

As a further feature of the invention the mixing regime adopted by the controller may follow a predetermined re-mixing cycle, once a signal has been given to the controller that additional water or ingredients have been added to the load (after initial mixing has been effected). The signal that such further ingredients have been added may be provided by manual intervention; or, in the case of water addition, may be provided automatically by a signaling device associated with the vehicle's water reservoir. Conveniently, this signal may be the same signal that releases the flow of water from such reservoir.

As a further feature of the invention the remixing regime that is followed upon the addition of further ingredients may be manually interruptible to the extent that drum rotation may be stopped, but not to the extent of permitting the drum to rotate in the discharge direction for more than a limited number of turns, or partial turns, such number being a function of the load present in the mixing drum.

As a further feature of the invention a display is provided which indicates the slump of the concrete contained in a load. Such display is provided not only in respect of the full initial load, but also after a partial discharge has occurred. Such display is generated in one variation by means of direct measurement of the hydraulic pressure required to turn the drum, in conjunction with knowing the immediate load contained within the drum. In another variation such display is generated based on the hydraulic pressure, in conjunction with the rotational history of the drum.

By a further feature of the invention a display may be provided which presents a progressive indication of the projected effect on slump of the addition of water, as such water is added. Such display is provided not only in respect of water added to a drum which is carrying its full initial load, but also where water is added to a partial load, after partial discharge has occurred.

By a further feature of the invention the actual load of concrete contained within a mixing drum supported at both its forward end and at its rearward, discharge end, may be determined from the measurement of the portion of the load being carried at the forward end only. This is effected dynamically, while drum rotation is occurring at a constant speed.

Drum rotational speed is determined by measuring the time interval between the passage of at least two circumferentially spaced markers on the drum past a pick-up mounted on a non-rotating portion of the vehicle, and taking into account the direction of drum rotation, dividing the space interval between such markers by such time interval. Multiple markers constituted by bolt-heads on the drum may conveniently be so used. As a further feature, the calculated rotational speed may be determined by averaging two or more such individual rotational speed determinations.

By a further feature of the invention the rotational history of a drum is recorded by transferring signals derived from the signals generated by such drum markers to a series of digital registers, and providing a record of the time when such transfers occur.

By a further feature of the invention a cement mixer vehicle having an on-board water supply is provided with an electrical sensor to detect water discharge, and a record is made of the occasions and periods during which such valve is open by transferring a signal which corresponds to the valve being open to a series of digital registers, and providing a record of the time during which such transfers occur.

The foregoing summarizes the principal features of the invention. The invention may be further understood by the description of the preferred embodiments of the invention in conjunction with the drawings, which now follow.

In summarizing the invention above, and in describing the preferred embodiments below, specific terminology has been resorted to for the sake of clarity. However, the invention is not intended to be limited to the specific terms so selected, and it is to be understood that each specific term includes all technical equivalents which operate in a similar manner to accomplish a similar purpose.

SUMMARY OF THE TABLES

Table 1 is a partial demonstrative listing of the software utilized by the controller in carrying out its functions.

Table 2 is a listing showing the variables addressed by the controller, and their default conditions.

DESCRIPTION OF THE PREFERRED EMBODIMENTS

Figure 1:
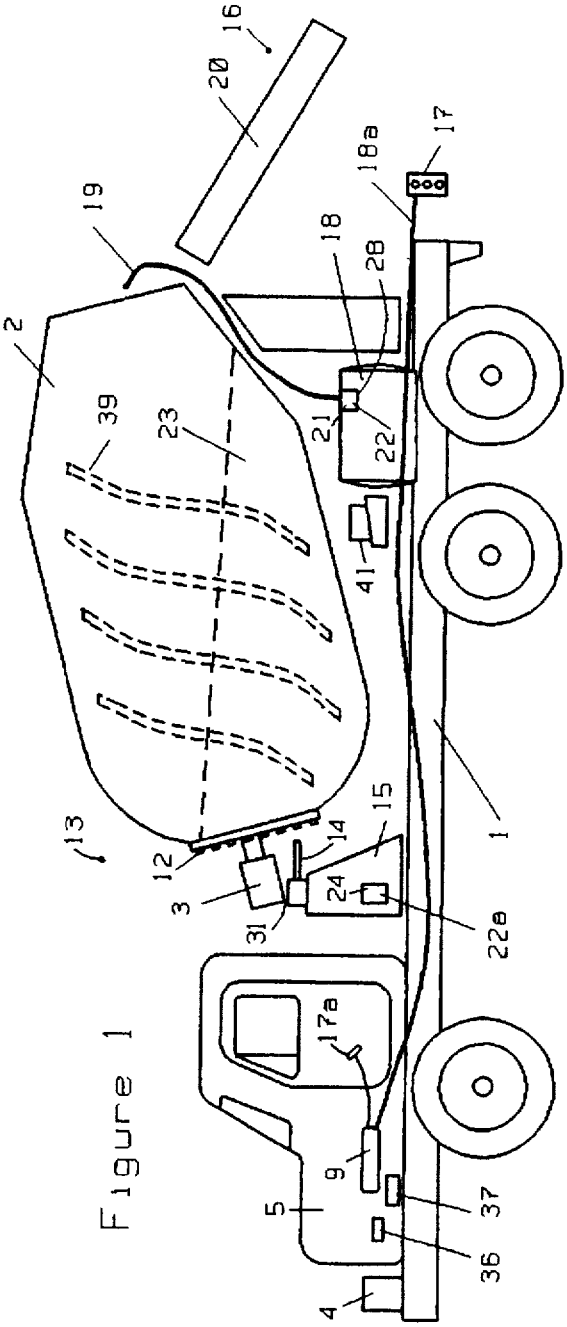
FIG. 1 is a side view of a cement mixing truck in outline identifying key parts.

In FIG. 1 a schematic depiction of a mobile mixing vehicle 1 is shown. A drum 2 is mounted on the vehicle 1, driven by a hydraulic motor 3. This motor 3 operates by means of pressurized hydraulic fluid supplied by lines (not shown) that are connected to a hydraulic pump 4. Typically, the pump 4 is mounted in front of the vehicle engine 5, centered over the front bumper 6, as shown in FIG. 2.

Figure 3:
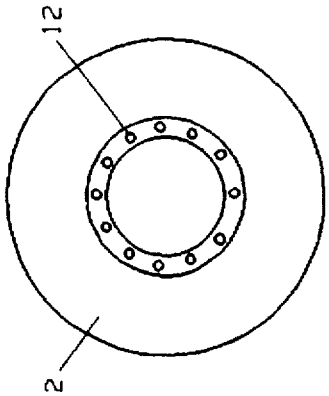
FIG. 3 is a front view of the mixer drum showing a circular array of bolt-heads.
Figure 4:
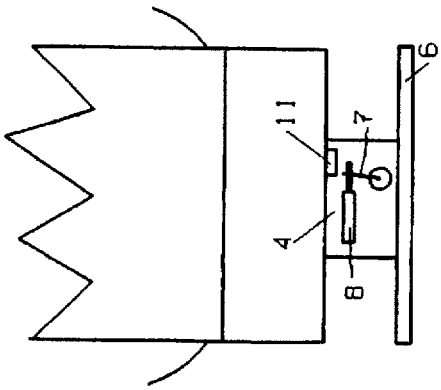
FIG. 4 is a schematic top view of the hydraulic pump mounted forward of the vehicle engine, including a depiction of the stroke control arm.
Figure 2:
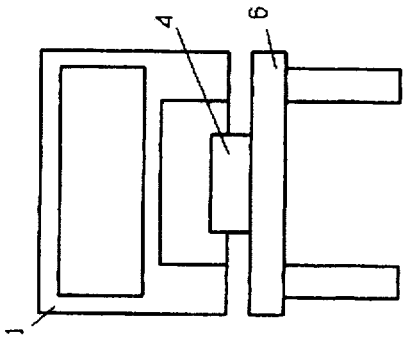
FIG. 2 is a front view of such truck showing a hydraulic pump with a stroke control arm schematically depicted.

The pump 4, as shown in detail in FIGS. 2 and 4, is controlled as to its delivered rate of flow of hydraulic fluid by a stroke control arm 7. This arm is activated by an electrical or hydraulic actuator 8 that is controlled by the driver, normally. In the present invention, both the driver and the controller 9, provided as an essential part of the invention, can send signals to the actuator.

The actuator 8 normally functions by stepping, in response to input signals, to move the stroke control arm 7 in either a first direction, to cause the drum to rotate in the mix direction, or in a second direction, to cause the drum to rotate in the discharge direction. The further the stroke control arm 7 is displaced towards its outer limits, the more fluid is pumped to the hydraulic motor 3, and the faster the drum 2 will turn. A dead zone exists in the central position for which no drum rotation will occur.

A control arm pick-up switch 11 (or switches) detects whether the stroke-control arm 7 is located in the dead zone, the mixing direction position or the discharge direction position.

The driver is provided with a dual-pole, three-position drum control switch 17 that conveniently is attached to the controller 9 by a long extension cable 18A. This allows the driver to control the stroke control arm 7 and drum motion while standing at the rear 16 of the vehicle 1, overviewing discharge or inspecting the load of concrete 23 in the drum 2. A parallel switch 17A is also available in the cab. The drum control switch 17 conventionally may be displaced between a mix direction and a discharge direction. Being spring-loaded, it will return to the central neutral position upon release. While held in either extreme, the actuator 8 will respond by stepping in the indicated direction. The central position does not necessarily correspond to a stopped condition for the drum 2. Rather it corresponds to the actuator 8 being stopped at its most recent position. This may correspond to various rates of drum rotation in either direction.

The drum 2 typically is constructed with a circular array of bolt heads 12 at its forward end 13. A magnetic or mechanical rotation detecting pick-up or detector 14 is mounted on the pedestal 15 which supports the hydraulic motor 3 on the frame of the vehicle 1.

This rotation detector senses the passage of the bolt heads 12 and sends a signal accordingly to the controller 9 by wires (not shown).

A control display panel 24 is also provided by which more complex commands may be given to the controller 9.

A water reservoir 18 is mounted on the vehicle 1. Customarily it is pressurized by air from the vehicle's pressurized air system (not shown) or may be operated by gravity. A hose 19 extends from the reservoir 18 to allow addition of water to the drum 2, or to wash down the concrete delivery chutes 20. A valve 21 is incorporated with the hose 19.

Optionally, a water flow detector 22, which may be provided by use of an electrically actuated valve 21 or by a separate flow detector, may be provided. The flow detector 22 provides a signal to the controller 9 when water is flowing from the reservoir. By prior calibration, the rate of water flow is known, and by timing the period that the valve 21 allows water to flow, the quantity of water released may be known.

The controller 9 cannot distinguish between use of the water reservoir 18 to provide wash-down water, and water for addition to the load of concrete 23 in the drum 2. Therefore, a water-addition switch 30 is provided at the control panel 24 to enable the driver to signal to the controller 9 that water is being added to the load 23. This water-addition switch 30 may also be located at the end of the extension cable 18A. Once it is activated the controller 9 responds in accordance with its pre-programmed schedule.

The forgoing description includes a number of prior art components. The added physical features associated with the invention include the controller 9, the control arm pick-up switch 11, the use of bolt-heads 12 to activate the rotation detector 14, the control-display panel 24, and the fact that signals from the driver's manual drum control switch 17 are routed through the controller 9, rather than proceeding directly to the actuator 8.

One of the objects of the invention is to provide an automated control system which allows drivers a degree of discretion to control the rotation of the drum manually. Further, it is intended that the driver be provided with controls of the customary form, with which he is familiar.

Figure 12A:
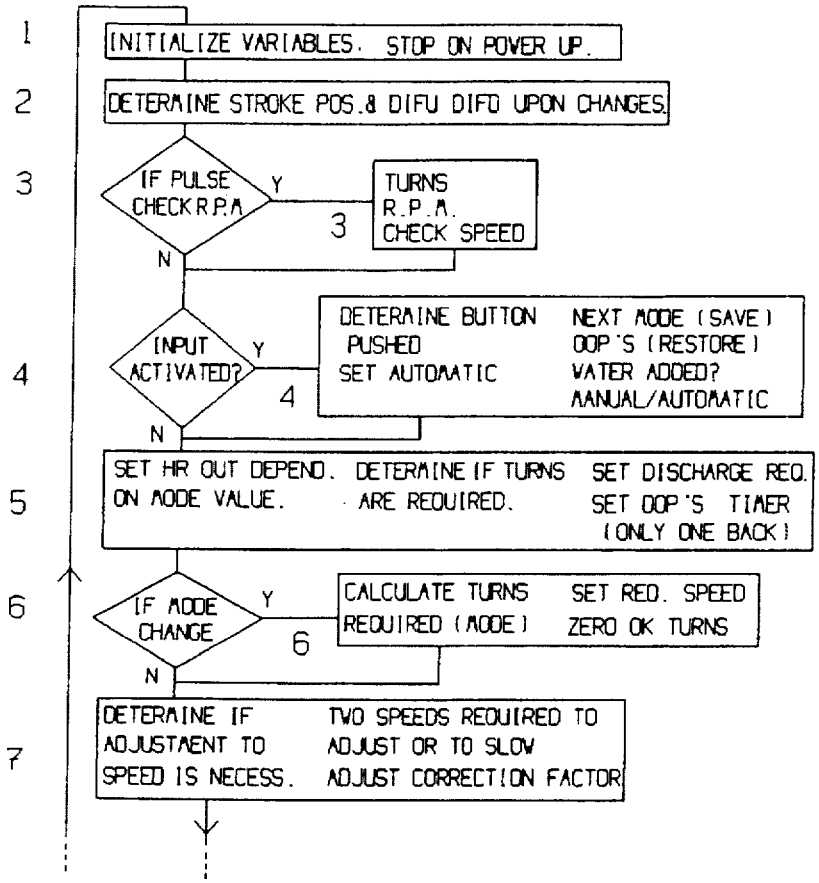
FIG. 12 is logic flow Table 1 is a partial demonstrative listing.

FIG. 12 shows the logic flow within the controller 9, and Table 1 is a partial software listing of commands, written in the language "C", to execute the required logic flow for exemplary routines for determining slump and the change in slump when water is added to load of concrete. Lastly, Table 2 lists the variables accommodated by the controller 9, and their source or default values. The controller 9 is an OMRON-Brand "C28K" programmable controller, or equivalent, whose operation in conjunction with the software will be understood by those skilled in the art.

Driver Controls

As indicated above, the standard existing manual control system for a mobile mixer provides the driver with a spring-loaded, three position drum control switch 17 by which the hydraulic pump 4, providing pressurized fluid to rotate the drum 2 may be stepped progressively to produce higher or lower volumes of fluid flow in either the mixing or discharge directions.

In accordance with the invention, the controller 9 is activated only when the drum 2 is turning in the mixing direction. If the drum 2 is stationary, or turning in the discharge direction, then its operation is entirely directed by manual commands originated by the driver in the usual way. This is, however, subject to the interdiction against discharge until certain conditions are met, as described further below.

When the driver activates the drum 2 to turn it in the mixing direction, the controller 9 does not initially intervene. This is to allow the driver time either to reverse an error or to rotate the drum 2 in the mixing direction in order to observe the load 23 of concrete or adjust the drum's position. During this period the driver may advance the drum speed to its full limit if he wishes. However, after a predetermined "grace period" during which rotation in the mixing direction is occurring (chosen as 15 seconds in the preferred embodiment), the controller 9 automatically assumes control of the drum speed. In doing so, the controller 9 reverts to the pre-programmed mixing regime—at the appropriate stage according to the load's past history. This stage is determined in accordance with a memory maintained by the controller 9 of prior treatment of the concrete and a comparison with the preferred mixing program, also contained in a memory.

In the event that the driver has added ingredients, such as water or plasticiser, then a manual signal may be given by the driver to enter a "re-mix" cycle or the controller 9 may initiate remixing automatically in response to signal from sensor 22. This cycle then becomes part of the mandate governing the operation of the controller 9 until the predetermined length of mixing appropriate to the re-mix cycle has been completed.

It has been known to provide automatic speed control systems for mixers that cause such mixers to pass first through a high speed mix cycle, followed by an automatic transition to the agitation cycle. It has also been known to render such mixing regimes interruptible, whereby upon a manual command, mixing at the appropriate stage in the mixing regime will resume.

However, no system has been created which will allow the mixing cycle to be manually interrupted, and then will automatically, and of necessity, re-enter a predetermined mixing regime at the correct stage when rotation in the mixing direction resumes. As a preferred embodiment, this is effected by the mere step of manually initiating rotation of the drum in the mixing direction for a time longer than the grace period. No interruptible system has been proposed that ensures that concrete will necessarily be mixed in a predetermined way until the appropriate mixing stages have been completed. No interruptible system has been proposed which prevents the discharge of concrete until the appropriate mixing stage or cycle has been completed.

These features are important as they ensure that drivers can not subvert the controller 9 and avoid following the proper mixing regime. The mere act of initiating mixing, in accordance with the invention causes the automatic mode to be engaged. This "auto resume" action is a valuable feature of the invention because, beyond the initial grace period, control over the processing of the concrete, while the drum is turning in the mixing direction, is assumed automatically by the controller 9.

To disengage the controller 9 using the conventional controls, it has been determined that it is preferable for the driver to first provide a short initial manual signal for the drum 2 to turn in the mix direction (preferably of 2 or so seconds in order to distinguish from voltage transients). Thereafter, the driver may move the drum control switch 17 in the discharge direction to cause the drum 2 to slow down, stop, or turn in the discharge direction.

The reason for requiring activation of the drum control switch 17 in the mix direction in order to disable the controller 9 is that a signal based on a command to move the hydraulic pump 4 towards the discharge direction may erroneously cause the drum 2 to enter discharge. Particularly if given when the driver is distracted by traffic, this could result in the discharge of concrete onto a public street.

Automatically Controlled Mixing Regime

Figure 5:
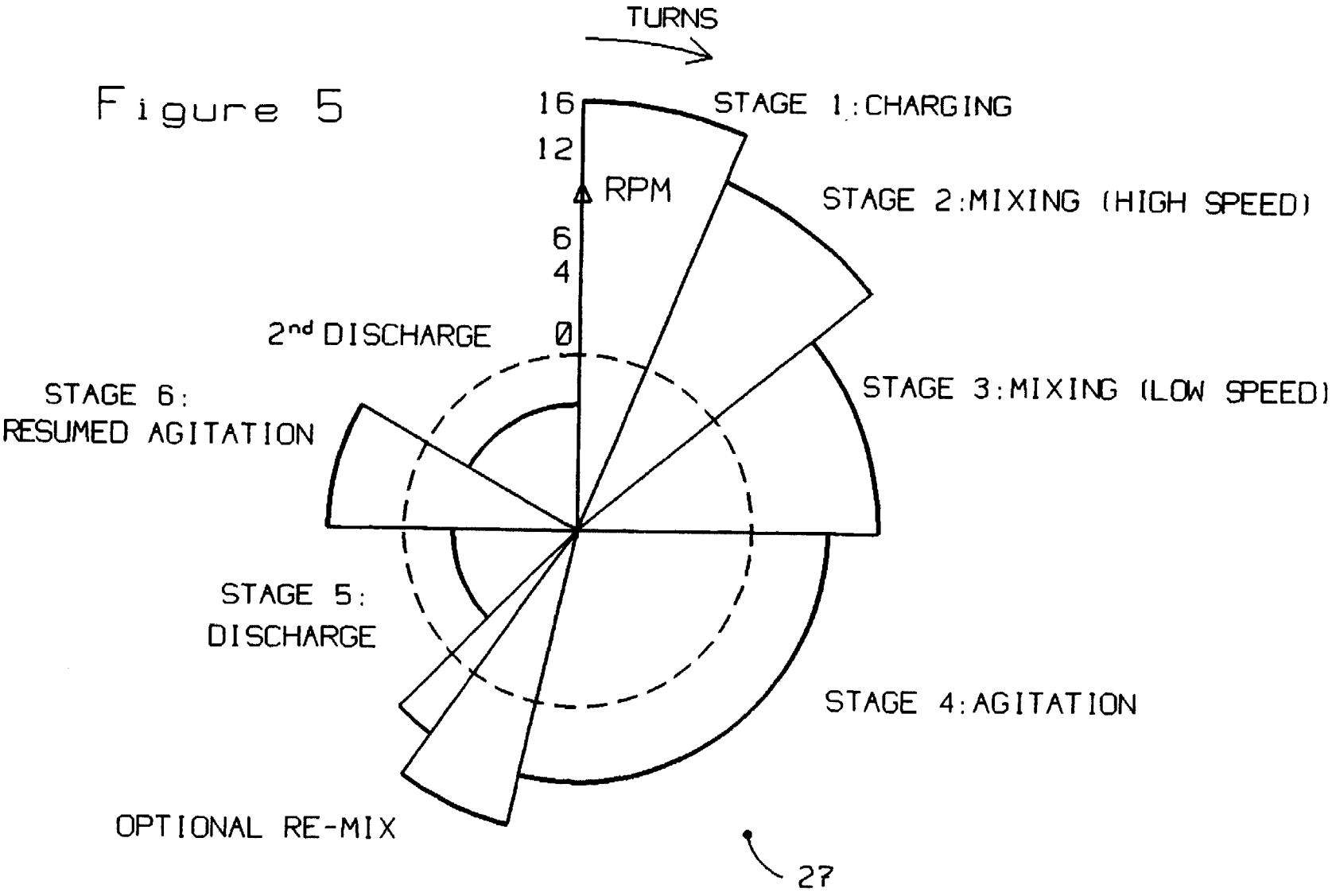
FIG. 5 is a schematic depiction of the mixing regime and the various cycles that a load of concrete may experience in accordance with the invention.

The controller 9 is adapted to pass through a concrete processing regime 27, as shown in FIG. 5, which includes the following steps or stages:

1. initial charging—drum rotates in mixing direction at maximum speed (15–20 rpm)
2. first (high) mixing speed
   drum rotates in mixing direction at an initial, high mixing speed (preferably around 11–12 rpm)
3. second (reduced) mixing speed
   drum rotates in mixing direction at a reduced mixing speed (preferably around 6–7 rpm)
4. agitation speed
   drum rotates in mixing direction at minimum speed (preferably 1½–2½ rpm)
5. discharge of concrete
   drum rotates in discharge direction (nb: actual discharge does not occur until after about 1 turn in the discharge direction, depending on load)
   manually controlled, including speed
6. resume agitation pending further discharge
   part 1—before 50% discharge has occurred
   part 2—after 50% discharge has occurred.

In step six, if 50% of the load has been discharged, the mixer is ready to re-enter step number one and be charged with a new load. It will not do so automatically, but will await a manual signal. The controller 9 is programmed to provide that the drum 2 cannot re-enter the charge stage until a certain percentage (50%) of the load has been discharged. Therefore agitation after when less than the required partial discharge (e.g. 50%) has occurred may be considered to be a first part of the sixth step, with a second part, constituting agitation after 50% discharge has occurred, being necessary in order to access and re-enter stage 1.

At any time during stages 2 to 6 water may be added to the concrete from the portable reservoir 18 carried by the vehicle 1. Water is normally added in stage 1 by the batch mixing station as part of the initial charging of the mixing drum to produce a wet load. There is normally no need to add water during the first initial high speed mixing cycle, stage 2, as a reasonable judgment may not be made as to the need for further water until an initial degree of mixing has occurred. After the conclusion of stage 2 the driver may add water at any time that he feels this is necessary.

The overall mixing regime is initiated manually once charging is completed by the driver by issuing a "start" command to the controller 9 to enter stage 2.

Figure 11:
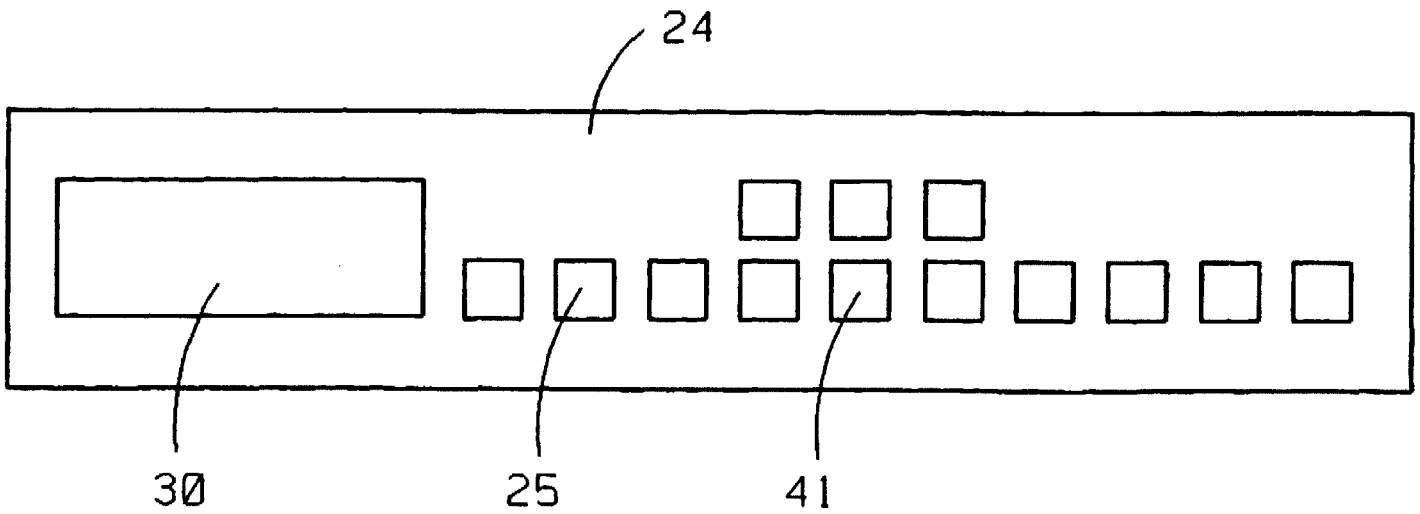
FIG. 11 depicts the control panel as provided to a driver whose vehicle incorporates a system in accordance with the invention.

This is done by activating a button, switch or entering a number from the keypad 25 on the control panel 24 as shown in FIG. 11. To assist the driver, the control panel 24 will display in window 30 the stage which has been reached by the controller 9. Before entering stage 1, the controller 9 must be indicating that it has at least reached stage 6 with at least 50% of the load discharged.

In order to allow for operator error at this first stage, a special "grace period" in the form of a sixty second interval is provided on entering both stages 1 and 2 by which a signal may be entered to nullify the last command. If such a nullifying signal is given, the controller 9 will revert to the immediately previous stage. Once the sixty second interval has passed, the controller 9 will automatically continue the stage that it has already reached unless interrupted by having drum rotation stopped by the driver. Upon resumption of drum rotation at the driver's command, the controller 9 will resume the mixing regime 27 at the appropriate stage that has been reached.

On completion of charging, a signal must be provided to the controller 9 that stage 1 is completed. This must be provided either by the driver or by remote control from the batch plant. The controller 9 will then await receipt of a key piece of data, this is the volume of concrete that has been loaded. This information may be provided by the driver, based on the load manifest or bill of lading provided to him by the batch plant operator. Or, it may be provided remotely from the batch plant. The volume of concrete loaded can be conveniently entered by the driver using the numeric key pad 25 or other input devices. Alternately, such signal, along with the earlier signal that charging is concluded, may be transmitted from the batch plant to the controller 9, as by an infra-red system. This latter arrangement has the advantage of minimizing the number of turns that occur at charging speed, and that would otherwise contribute to over-mixing of the concrete. It also allows the driver to move his vehicle from the loading station more quickly.

Once this information has been entered, the controller 9 awaits receipt of a signal from the driver to enter stage 2. Upon receiving such signal the controller 9 will automatically cause the drum 2 to enter the first phase of the mixing cycle—high speed mixing.

The object of the high speed mixing cycle is to entrain air in the concrete. It is believed that for most standard size mobile mixers in North America, a preferred initial mixing speed, suitable to maximize the entrainment of air, is in the range of 11–12 rpm.

Figure 10:
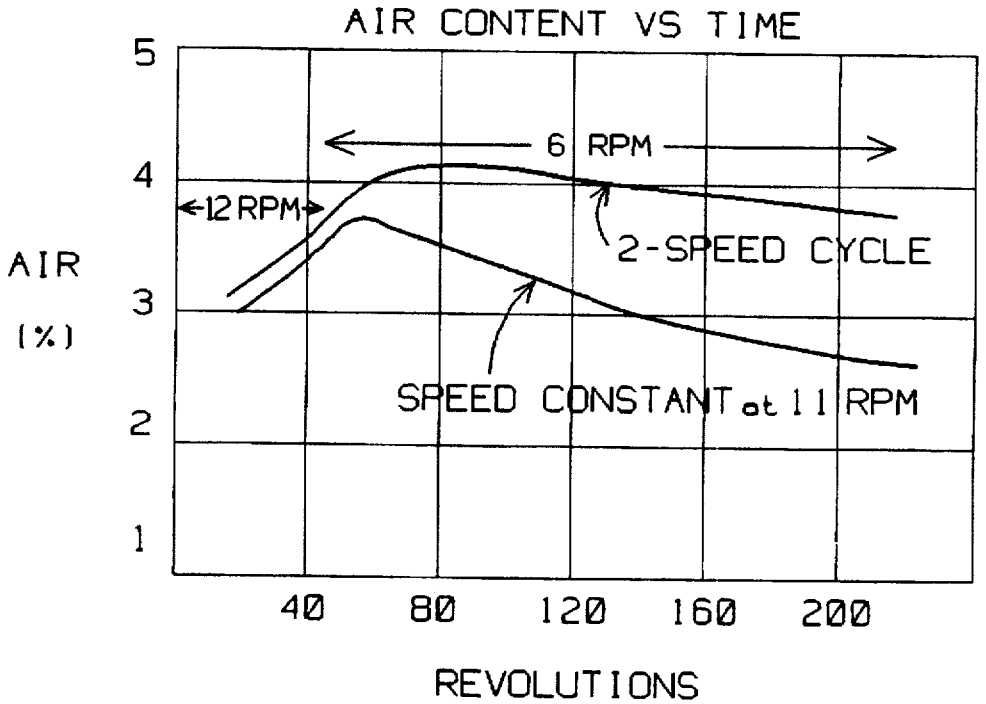
FIG. 10 is a graph that shows air content as a function of accumulating revolutions for both a constant and a two-speed mixing cycle.

The number of turns chosen for stage 2 is a fraction of the total number of turns recommended to achieve satisfactory mixing. It is during this stage that air is effectively entrained. It has been found that 30–40 turns out of a total of 70 mixing turns is a satisfactory fraction, for a full load, in order to achieve this effect. FIG. 10 shows a comparison of air entrainment as between a constant 11 rpm cycle and the two-stage cycle proposed herein. Reduced turns are appropriate for less than full loads.

Once the requisite number of turns for stage 2 have been completed, the controller 9 will automatically advance to stage 3. In this stage mixing continues, but at a lower speed. A low speed is desired in order to ensure that air that has already been entrained is not lost. Further such lower speed avoids accelerating the setting process by adding additional energy to the mix. For this purpose, a mixing speed of 6–8 rpm has been found suitable for stage 3.

An advantage of carrying-out the balance of mixing at this lower speed is that drivers are able to drive their vehicles to the work site while this second phase of the mixing cycle is being concluded. Normally, it would be unsafe to drive a mixer with a load of concrete that is being rotated at 10–12 rpm. However, it is practical to drive a mixer vehicle with a load of concrete that is being mixed at 6–7rpm.

Because of the presence of the drum speed control systems within the controller 9, the drum 2 will not speed-up in accordance with engine rpm as the vehicle 1 is being driven. Further, the drum speed control system allows the drum 2 to be turned at a speed which is close to the lower recommended limit on the range of mixing speeds. This is an important contribution to concrete quality and consistency.

The normal tendency of drivers is to mix at maximum rpm, 16–18 rpm, while standing in the batch plant yard. This is done in order to conclude the mixing cycle as quickly as possible and then clear the yard. With the two-stage cycle imposed by the controller 9, the objectives of maximizing the concrete's quality and consistency, maximizing the entrainment of air, avoiding over-working and avoiding unnecessary consumption of permissible turns can be reconciled with accommodating the driver's desire to depart promptly.

Once the total number of mixing turns have been effected, the controller 9 will automatically move into stage 4—agitation. During this cycle the concrete is agitated at the minimum rotational speed needed to prevent separation of the components of the concrete. This is preferable around 1½ to 2½ rpm.

An important feature of the invention is that the controller 9 will not permit the discharge of concrete until the appropriate mixing cycle has been completed. Thus, discharge cannot be effected until stages 1 to 3 are concluded. A further interdiction against discharge is imposed by the controller upon the initiation of any re-mix cycle, as further described below.

The controller 9 will maintain stage 4 agitation until the driver intervenes to stop the drum 2, or reverse its direction to effect discharge. At the job site the driver will usually stop the drum 2 and execute at least one discharge turn in order to bring concrete up to the discharge end to inspect its slump condition. If the concrete is too stiff, then water will be added.

Displays and Commands Available to Driver

The controller 9 is provided with a means to present a read-out for the driver, which may be in the form of light emitting diodes (LEDs), a liquid crystal display 30 or series of dedicated lights mounted on the control panel 24, which is capable of providing the following indications, if not continuously then consecutively to the driver:

1. speed of drum (over a bolt interval)
2. speed required for the present step in the mixing regime
3. total turns in entire mixing regime accumulated to date
4. total turns in the acceptable mix speed range that have occurred to date in the mixing regime
5. turns done in the immediate mix cycle
6. turns left in the immediate mix cycle
7. target turns required in the immediate mix cycle
8. time delay until mixing is completed
9. ERROR indications
10. cycle or stage number
11. automatic mixing or suspended automatic (discharge/or stopped) mode
12. Return to prior step in mixing regime function is available to cancel Discharge or Initial Charging and Mixing Cycles.
13. total of all turns since a certain date (for maintenance)
14. quantity of truck water added by the truck driver in the mixing regime to date
15. quantity of water added after initial mixing has been completed
16. resulting change in slump estimated from addition of water measured or recorded by the driver
17. volume of concrete remaining in drum.
18. slump of concrete in drum.

Input means, preferably in the form of a numerical key pad 25 with an "Enter" key and/or supplementary buttons and/or switches, is provided for the driver to issue commands to the controller 9. The commands that may be issued by the driver are as follows:

1. Initiate Charging cycle or Mixing cycle
2. Return to prior step to cancel Charge or Mixing cycles (if activated within 60 seconds)
3. Stop
4. Disengage automatic (allows drum to be stopped or discharge to occur. Also allows turns in the mixing direction for 15 seconds at any speed after which automatic is re-engaged)
5. Engage automatic directly
6. Advance stroke control arm manually in mix direction (subject to automatic over-ride as per 4 above)
7. Advance stroke control arm manually in discharge direction (unlimited discretion unless water has been added or mixing is incomplete)

8. Speed Setting on Discharge
9. Enter Remix cycle as when

| |
|---|
| on addition of water or other ingredients special mix cycle after transportation, a long agitation period or a non-agitation period has passed |

10. Scroll or jump through various read-outs (Output of Displays

Slump Adjustment

Figure 8:
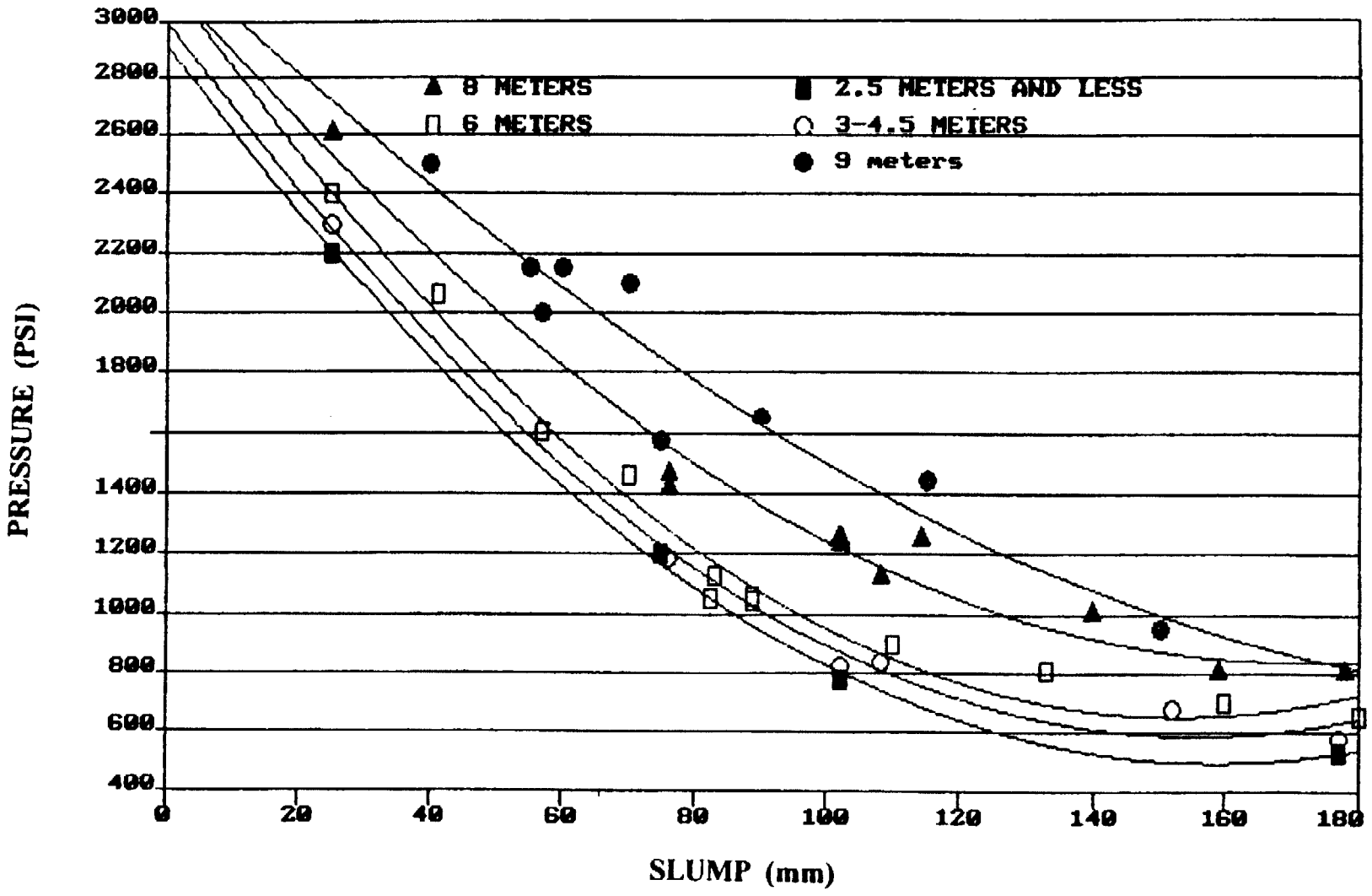
FIG. 8 is a graph showing hydraulic motor pressure as a function of slump condition for various volumes of loads of concrete.

The consistency or viscosity of concrete as determined by the standard slump test, hereafter referred to as its "slump", is normally adjusted by drivers at the batch plant after an initial degree of mixing has occurred. This is effected by the addition of water. Such adjustments are necessary because of uncertainty as to the amount of moisture contained in sand and aggregate used to charge the mixer. The batch plant operators therefore prefer to err in charging the mixer by including a conservative amount of water in the mix. The driver then corrects this by visually judging the amount of water needed to adjust the slump of the freshly mixed concrete to the appropriate degree of consistency. Alternately, the driver may be provided with a system for indicating the slump condition of the concrete. One method to achieve this is to correlate slump for varying loads with the hydraulic pressure needed to maintain a specified level of drum rotational speed. This correlation is shown in FIG. 8. According to prior art systems of this type, such pressure measurements have been effected at elevated constant rpm's, e.g. 18 rpm. This elevated speed is customarily the maximum that the vehicle motor 5 will support. This speed varies considerably with viscosity or slump and with the volume of the concrete.

As a preferred procedure, according to the invention, hydraulic pressure is used as a measure of slump by rotating the drum at a relatively low speed, below 6 rpm, e.g. at agitation speed, preferably 1½–2 rpm. At this speed wear on the agitation blades 39 does not significantly affect this measurement and the calibration curves represented by FIG. 8 remains valid for an extended period of time. In making low-speed measurements it is further desirable to average pressure readings over the interval 40 between passage of successive internal agitation blades 39.

With the passage of time and further agitation, the concrete 23 will stiffen. A slump test at the job site may determine that the concrete is too stiff to be workable, and that the slump should be adjusted, as for example from 2 inches to 5 inches.

Drivers will then add water to obtain the desired degree of slump. As the addition of excess water is highly undesirable, they will do so conservatively, by a series of additions of limited amounts of water interspersed by mixing and visual inspection. Since inspections require the driver to mount the vehicle and sometimes adjust the drum to present concrete for viewing, this necessarily takes time. Further, a series of short mixing cycles are not as effective in assuring adequate mixing as an extended mixing cycle.

One object of the invention is therefore to provide a guide by which an indication is given to the driver as to the projected effect on slump of adding a given quantity of water.

To effect this result the controller 9 is provided with an input through keys 41 as to the volume of concrete that has been loaded in the mixing drum. Subsequently, as an optional feature, the controller 9 may be provided with an input as to the volume of concrete that has been discharged. This latter information may be manually entered, or may also be generated automatically as further described below.

It is known or can be determined that, for concrete near the optimum slump value, a "Slump Factor" exists by which a given amount of water e.g. 3 liters of water for 1 cubic meter of concrete, will cause a change in slump (an increase) of a given amount, e.g. 1 cm.

According to the invention a metered outlet 28 may be installed on the vehicle water reservoir 18 and a water flow detector 22 may provide signals to the controller 9 when water is being released. This may be effected through use of a calibrated orifice having a known flow rate when used in conjunction with a predetermined pressure head for the water. (Air being supplied from the vehicle's compressed air system). The opening of the valve 21 on the reservoir 18 can then be timed to determine the quantity of water being added. The effect of adding such quantities of water on the slump of the concrete can be calculated by the controller 9 in accordance with the following formula:

$$\text{Change in Slump} = \frac{\text{Volume of Water}}{\text{Volume of Concrete (or "Load")}} \times \text{Slump Factor}$$

A signal may then be provided to the driver, either visually or auditorially, indicating progressively the projected effect on slump that will arise from the water as it is being added. When the desired value is reached, the driver may shut-off the water. Alternately, the driver may input into the controller 9 a target value for the change in slump, and the controller 9 can shut-off the water flow when this target is reached, using an electrically activated valve 21.

The foregoing procedure premises that the volume of concrete in the mixing drum is known. After a partial discharge has occurred it will be necessary to know the residual quantity of concrete in the mixing drum in order to utilize the foregoing feature for further adjustment of the slump.

An approximation for the quantity of concrete remaining in the mixing drum 2 is provided by applying the following formula:

$$\text{Load} = \text{Original Load } X \; [1 - \text{Discharge Rate/Turn} \times (\text{number of discharge Turns} - \text{"}N\text{"})]$$

where the Discharge Rate/Turn is the rate at which the inner spiralled fins of the drum deliver concrete to the discharge mouth of the drum once discharge has commenced, and, "N" is the number of turns necessary to lift concrete from the interior of the drum to the discharge mouth whereupon discharge commences. This number varies with the amount of concrete in the drum. For instance, with 1 cubic meter of concrete present in a standard drum, it may take on the order of two turns of the drum to commence discharge. While with 9 cubic meters present, it may require only half a turn. This parameter may be determined by making calibration tests. The above formula may then be easily solved by iteration or by other standard mathematical techniques. Alternately, an average load may be assumed and this figure adopted for the formula.

For a 9 cubic meter capacity London Machinery Company Limited "Action 90" (Trade Mark) mixer filled with an average load of 6 cubic meters, it has been found that the value of "N" is approximately 1.25. As the addition of supplementary water will normally occur on initial discharge with the drum 2 near full load, the typical load value will suffice in most cases in providing the controller 9 with a rough adjustment value for calculating the effect on slump. A slightly more accurate value for "N" may be established by testing for its value at half load, and projecting its rate of change as being linear between full and half load, and below.

It is also possible to determine the actual load of concrete being carried in a mixer by more direct measurement.

Figure 6:
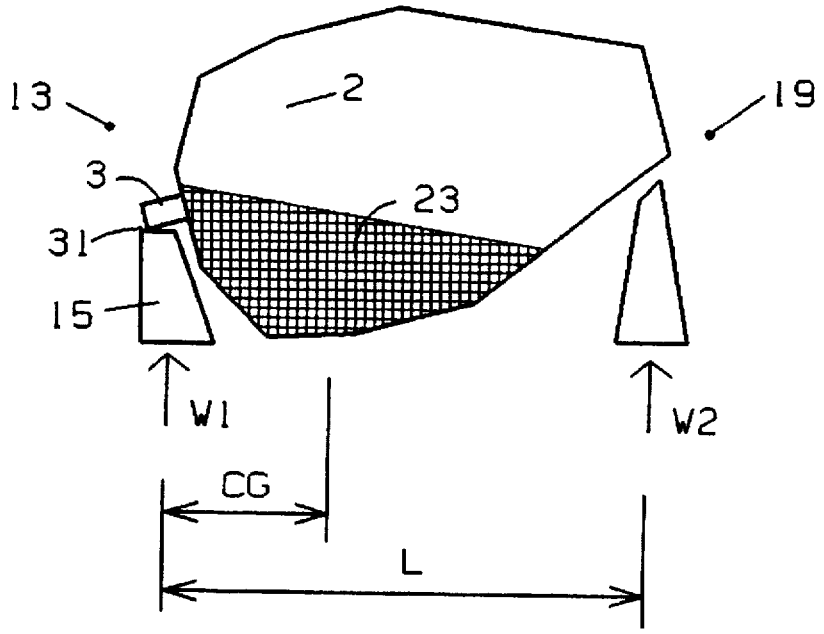
FIG. 6 is a side view of a mixing drum showing the distance from the hydraulic motor base to the center of gravity of the drum with a partial load.

Referring to FIG. 6, if both the weight $W_1$, at the forward end 13 of the drum, and $W_2$ at the rearward end 19 are determined by measurement (as by strain gauges, then the center of gravity (CG) may be calculated as:

$$CG=(W_2\times L/W_1)+W_2$$

And the volume (Vol) of concrete in the drum may be calculated as:

$$\text{Vol}=(W_1+W_2)/\text{Density of Concrete}$$

Figure 7:
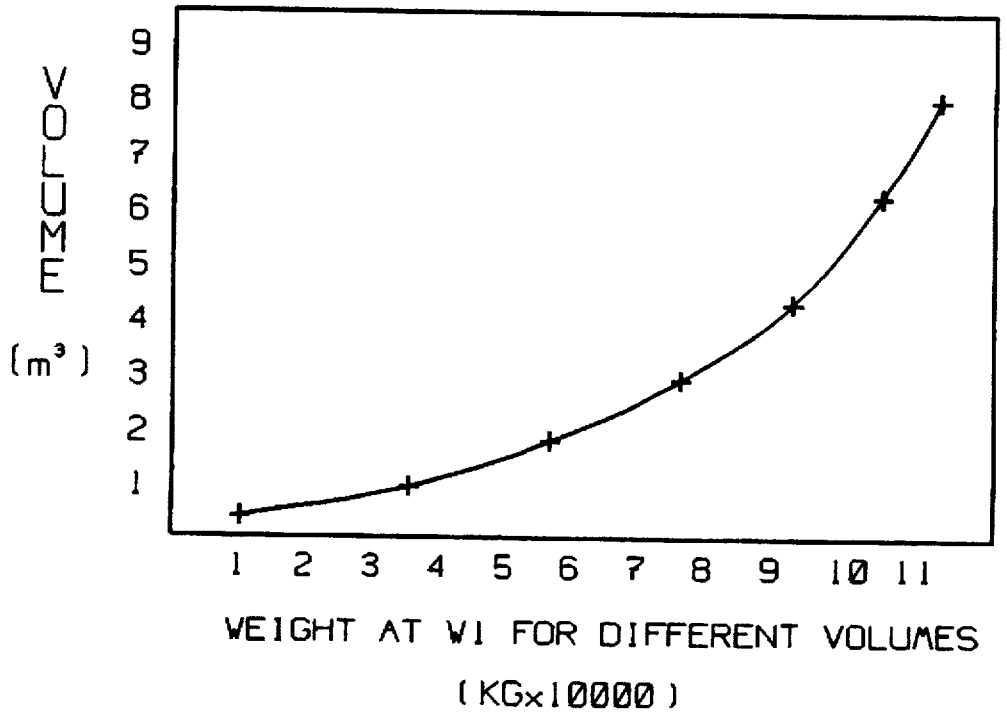
FIG. 7 is a graph showing the effect of the correlation between the volume of concrete loaded and the forward end weight of a mixing drum when rotating particularly as it is affected by the shifting in the location of the center of gravity.

If only $W_1$ or $W_2$ are known then the volume can still be determined using the original measurement and a calibrated curve for each specific drum, as shown in FIG. 7. The effect of the shifting of the center of gravity due to changes in slump is small compared to the overall measured load. It is practical, therefore, to use a single curve calibrated for a typical slump of, say, 5½ inches.

Determining Load and/or Slump by Direct Measurement

Another method of determining load may be accomplished by providing the forward hydraulic motor mount with a load measuring device 31, such as a load cell or strain gauge, by which the vertical load being transmitted to the vehicle frame may be measured.

This load measuring device 31 may be mounted on the pedestal 15 supporting the hydraulic motor as shown in FIG. 6. The drum 2 is then charged with a known volume of concrete 23, for which the center of gravity for such a volume, when rotating at a constant preselected speed (preferably at an agitation speed of 1½–2½ rpm) has previously been determined for this specific mixing drum. From this load a first calibration reading may be taken from the load measuring device 31.

After a partial discharge of concrete, the measured load will change. Knowing the schedule by which the center of gravity of the load shifts as the load is diminished, the residual concrete can be determined by reference to precalibrated curves for each type of drum 2.

Figure 9:
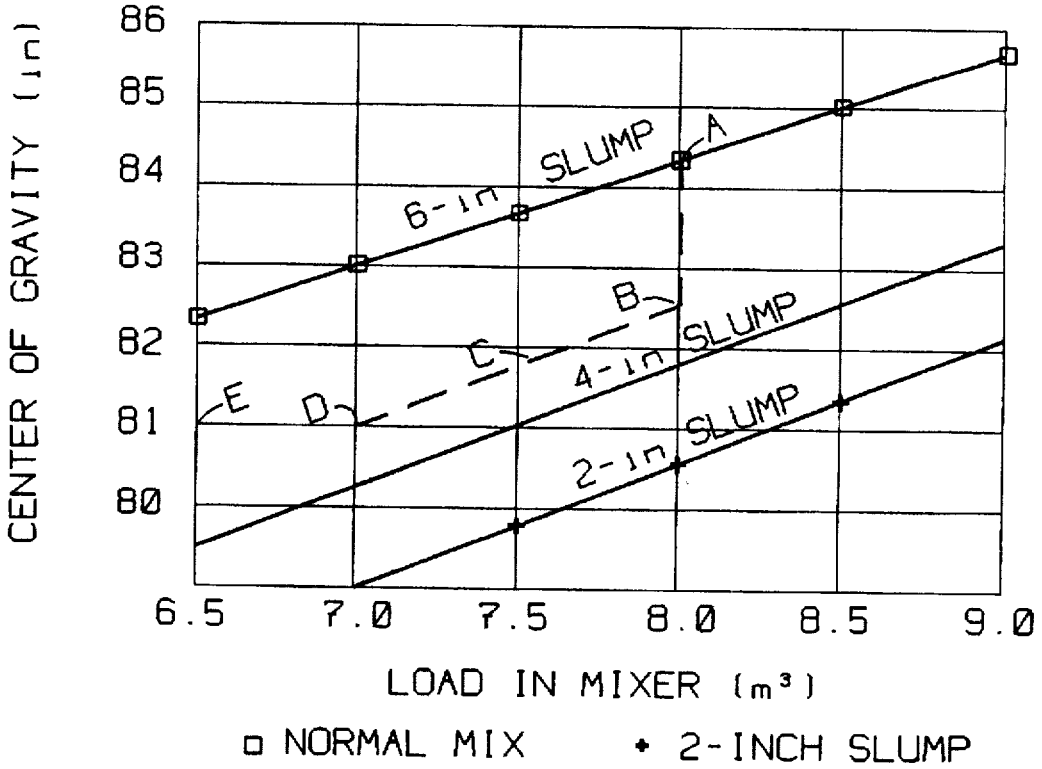
FIG. 9 is a further graph showing the location of the center of gravity as a function of concrete load, for concrete of various slump conditions. This Figure also shows a path A, B, C, D that traces out a partial discharge.

FIG. 9 shows a sample graph by which the center of gravity of a load of concrete is shown to vary with the load in the mixer. Initially, a known load of 8 cubic meters, having an initial slump of 6 inches, may be imagined as being located at point "A". As mixing progresses, the slump will change and may shift the focus of operation of FIG. 9 to, for example, point "B" where the concrete slump is just above 4 inches. The "y" coordinate for point "B" may be established by direct measurement, since the load measuring device 30 will register the shift in the center of gravity.

If discharge then occurs, the focus of operation will then proceed along the path "C" to a point, for example "D", by which one cubic meter of concrete will have been discharged. Upon resuming agitation at standard speed the fact that one cubic meter of concrete has been discharged may be determined directly from the average value indicated by load measuring device 31. The output value from this device 31 will have changed to a level corresponding to the new value "E" for the location of the center of gravity. Thus, by reading this value, the position of "D" on the path "C" may be determined directly. This then provides a value for the residual quantity of concrete remaining in the drum 2, being in this example 7 cubic meters.

The load measuring device 31 must be calibrated and should preferably be utilized by recording the average reading it produces when the drum is turning at a preselected speed and the turning concrete has shifted to a stable distribution in the drum for which the center of gravity for such dynamically agitated load has been previously determined. Measurements should be taken for a period of time sufficient to establish a reliable average reading.

Thus, a means has been demonstrated whereby after partial discharge has occurred, the balance of concrete remaining in the drum may be calculated using the measured average load at the forward end of the drum, taking such measurements at the preselected speed and allowing for the shifting of the center of gravity of the concrete as the volume is reduced. One procedure described relies on the fact that the slump of the concrete will not have changed within the short period of time that it takes for the concrete to be discharged. The other allows for a change in slump. In most cases, changes in the slump of the concrete have only a slight effect on the actual load measured at the forward end of the drum. This is because the small variations created by a shift in the center of gravity are masked by the much larger effect created by the change in the weight of the load of the concrete.

Mandatory Remix on Water Addition Another automatic feature of the controller 9 is the "mandatory remix cycle" that is imposed when water or other ingredients are added to the mix.

The purpose of this remix cycle is to ensure that whenever material is added to the concrete, whether it be water, binders, super-plasticizers or the like, that such added materials are thoroughly dispersed in the concrete. An accepted industrial norm to achieve this result is to carry-out 30 turns at mixing speed. This norm, subject to the modification identified below, has been adopted in the preferred embodiment described herein.

To ensure completion of the remix cycle an interdiction circuit may be provided by the controller 9 for the drum motor 3. Such an interdiction circuit can be set to prevent the drum 2 from being rotated in the discharge direction until the required number of remix turns have accumulated.

For convenience of the vehicle operator, if any attempt is made to place the drum 2 into discharge format while this interdiction is in effect, a display may be generated at the drum control panel 30 indicating that turns in the discharge direction are forbidden until sufficient remixing turns have been effected.

Occasionally, a driver may wish to rotate the drum in the discharge direction, simply for inspection. To permit this, at any time during a mix cycle a limited number of turns, or partial turns, in the discharge direction may be allowed to occur before further turns in this direction are interdicted. This will allow the spiralled fins 39 within the drum to bring-up the load 23 in the manner of an Archimedes screw for inspection.

A signal that water has been added may either be given manually by the driver, or automatically, through the water flow detector 22 on the water reservoir in conjunction with rotation of the drum in the mix direction. In the latter case, to avoid false responses arising from electrical transients, the detector 22 may be required to signal an "open" condition persistently, as for 1–2 seconds, before the mandatory remix cycle is imposed.

When an automatic remix function is provided, it should preferably be based on receiving a confirmatory signal that the drum 2 is turning in the mix direction for more than a predetermined number of turns. By this feature the mandatory remix cycle does not arise if water is drawn while the drum 2 is stopped or turning in the discharge direction. This will allow for drivers to draw water for washing-out the drum 2 without having the controller 9 automatically impose a mandatory remix cycle.

A further optional feature is to provide programming to the controller 9 that will ensure that if water is added during discharge and then mixing is attempted, the mandatory remix cycle will occur unless the drum 2 has made a sufficient number of discharge turns after water ceased to be added to eject such added water from the drum 2. If sufficient turns to eject the added water have not occurred then, according to this optional feature, on any attempt to turn the drum 2 in the mixing direction, a mandatory remix cycle will be imposed.

The preferred rpm for a remix cycle is the minimum mixing speed, namely 6 rpms but remixing may occur in the range of 6–12 rpm. Because this is set by the controller 9, the driver cannot depart from this optimum. When the remix cycle is manually initiated, the driver is "locked-in" to having a full and proper remix cycle executed. The driver does have the freedom to choose whether to give the signal that ingredients have been added to the mix, and that the remix is appropriate. However, it is highly unlikely that such a remix signal would not be given, since the absence of any mixing would be apparent to co-workers at the job-site.

The signal that materials requiring remixing are being added may be given to the controller 9 by the manual activation of a special switch dedicated to this purpose. However, an alternate signalling arrangement may utilize the same drum control switch 17 that the driver is accustomed to using. The mandatory remix signal may be given by activating the lever on this drum control switch in the mix direction for an extended period of time. An appropriate time is a time period that is slightly longer than the length of time required to drive the hydraulic pump to the upper limit of its speed capacity. Thus a time of 7 seconds has been found suitable. This eliminates the need to provide a separate wire for the remix command to be communicated to the controller 9.

This means of providing a signal to initiate mandatory remix cycle is convenient as mixing vehicles already in the field customarily provide for the drum control switch 17 to be available for use on an extension cable 18A. Thus this same switch may be used to issue the command for a remix cycle, limiting the modifications required for the retrofit to the inclusion of appropriate circuitry in the controller 9.

Adjusted Remix Cycle

Reference has been made above to an industry recognized norm of utilizing 30 turns to effect remixing, once further ingredients are added to a full load of concrete. It has been now determined by the inventor that while 30 turns may be appropriate for a full load, it is not necessary to effect such a large number of remix turns if a partial discharge of concrete has already occurred. Rather, the number of remix turns may be chosen by applying the following formula:

$$\text{Remix Turns} = 30 \times \frac{1}{2} \times \frac{\text{Partial Load Volume}}{\text{Full Load Volume}} + (30 \times 1/2)$$

Methodologies for determining the partial load carried by a mixer after a discharge has occurred are described above. It has been found useful to adopt the above formula as the criteria by which the controller 9 imposes a remix cycle because drivers and workmen at a job site tend to be impatient. Particularly where the signal for a mandatory remix is to be given manually, any disincentive to effect such a command should be minimized. The truncation of the remix cycle is one means of reducing the inclination of the vehicle operator to avoid a remix cycle.

The truncation of the remix cycle also has the advantage of reducing the unnecessary working of the concrete. The mixing of concrete inherently advances its setting, reducing workability and decreasing its slump. The addition of supplementary water to overcome this effect has the negative consequence of reducing the ultimate compressive strength of the concrete. Accordingly, having determined that with a less than full load less turns are required to effect adequate mixing, this last feature of the invention contributes to providing concrete of a higher strength.

This same formula may also be applied to the initial mixing of concrete where less than a full load has been placed in the drum.

Remixing After a Period of Under-Agitation

Occasionally, concrete may be held in the agitation stage for an exceptionally long time. Alternately, rotation may be stopped for an extended period. In such cases it is appropriate to remix the concrete to overcome any separation that may have occurred.

This can be effected automatically using the controller 9 by providing a test procedure within the controller 9 that detects such conditions. Thus, the controller 9 may test repeatedly for periods of uninterrupted agitation or rest that exceed predetermined thresholds. Once such one of these conditions is detected an appropriate remix cycle may be imposed.

To ensure that such cycle is executed the controller 9 can prevent discharge until the required remix occurs. As discussed previously, the driver would then have to initiate rotation in the mixing direction to allow the auto-remixing cycle to proceed.

Recording Drum Rotational Speed

In accordance with the invention signals appropriate to record drum rotational speed signals are picked-up by the drum motion detector 14 from the passage of markers mounted circumferentially on the drum. Conveniently, these markers may be a series of even spaced circularly mounted bolt-heads 12 that are conventionally used as fastenings on the mixing drum 2. Each passage of a bolt-head 12 may then be used to generate a magnetic disturbance in the drum motion detector 14 that causes the drum motion detector 14 to send an electrical signal to a drum-motion counter portion of the controller 9.

As a new means for determining drum speed from such signals, the pulses generated from each bolt-head 12 may be stored and processed by digital electronic circuitry in a manner that provides a very precise measure of drum rotational speed, particularly at low speeds. This is accomplished by measuring the precise time interval occurring between signals arriving from the drum motion detector 14. Knowing the radial intervals between the marker on the drum that total up to an entire turn, the rpm may be precisely calculated by dividing the radial interval, converted to portions of a full turn, by the measured time intervals.

Due to slight variations in the locations and triggering effects of the markers 12 on the detector 14, some inaccuracies will occur. Such inaccuracies may be accommodated by storing the value for the measured value of the rpm for several measurements in a register or series of registers, and determining the average value over a series of successive counts. In such applications it is especially useful to utilize the circular array of evenly-spaced boltheads 12, usually being 6 or more in number, as this provides multiple readings suitable for averaging.

Recording Water Addition

To record water addition, an electrical waterflow detector 22 is attached to the valve 21 on the vehicle's water reservoir 18, or to a flow line 19 leading therefrom. On activation of the water-flow detector 22, a signal is sent to the controller 9 to input such event into a water-addition register that correlates water addition with time. In this manner, on arrival of the vehicle at the job site (or at any stage after water has been added to the mix) the state of the water-addition register may be inspected. If the turns recorded since water has been added are below the minimum turns required, then further turns may be effected until the required cycle is completed. With controller 9 in place and engaged, this will occur automatically.

Fuel-Saver Function

According to the basic design of the system, the controller 9 automatically adjusts the drum speed to an appropriate level, irrespective of the engine speed.

When a heavy load is being mixed the controller 9 will increase the volume of hydraulic fluid being pumped until either the desired speed is achieved or the vehicle engine 5, starts to stall from the load. It is customary for drivers to manually set the engine throttle at maximum speed in order to prevent stalling. This is wasteful as a maximum setting is usually far higher than necessary to achieve the desired result.

Accordingly, as an additional feature of the invention, the vehicle engine 5 may be provided with an electrically controlled throttle 36 that responds to signals from the controller 9. When setting the drum speed, the controller 9 simultaneously adjusts the vehicle engine throttle 36 to set the engine at the minimum speed necessary to maintain the desired drum speed. This serves to save fuel by avoiding running the vehicle engine 5 at excessive speeds.

Destroking the Pump on Startup

Drivers may typically shut down their engines at day's end with the hydraulic pump 4 still engaged. The next morning, when the vehicle is started, the vehicle starter motor 37 must not only crank the engine 5, but also turn the hydraulic pump 4 which is under load. This is a strain on the starter.

The control mechanism for the engagement or disengagement of the pump is customarily an electrically-valved hydraulic cylinder 8 which is attached to the pump control arm 7. In order to reduce the load on the vehicle starter 37, the controller 9, once starting is attempted, may automatically signal for the pump control arm 7 to move towards disengagement of the pump 4. Some hydraulic fluid must be pumped to activate the pump control arm actuator 8. But immediately as this occurs, the pump 4 is moved to a zero-stroke position, and the starter 37 is freed of this parasitic load.

Cement Saver Function

Concrete is stipulated by various standards, such as those of the TBBA, to have been treated with no more than a maximum number of turns. If this turns limit is exceeded, a load may be rejected. This is a very serious consequence.

While agitation speed is kept low to conserve turns, delays at a job site may result in total turns accumulating that approach the limit.

In order to extend the standby time that is permitted in such circumstances, the controller 9 may, once a predetermined number of turns has occurred e.g. 250, reduce the turning speed to an extra low level e.g. 1 rpm.

Conclusion

An automatic control system has been described which, along with its various optional features, will provide for delivery of concrete of a more reliable quality to job sites. A further advantage of this invention is that by controlling drum rotation to minimize the number of higher speed turns significantly reduces drum wear. This was shown by a comparative evaluation of drum wear on two similar mixers differing only in the presence of a controller on one of them. The wear rate on the drum with the controller was determined to be one fifth of the rate of wear on the drum that was not so equipped.

The foregoing has constituted a description of specific embodiments showing how the invention may be applied and put into use. These embodiments are only exemplary. The invention in its broadest, and more specific aspects, is further described and defined in the claims which now follow.

TABLE 1

```
#include "auto.h"
#include "listdm.h"
#include "aut.h"
#include "ahpc.h"
#include "history.h"
#include "str.h"

void download() ;
unsigned char make_cksum(unsigned char *);
void make_history(unsigned char *s,defhistory *ptrhis,unsigned int q);
void print_dm(void);
/* BASEPAGE extern unsigned int *ptrdm;
   BASEPAGE extern defch *ptrch; */
#if !defined(TURBO)
void get_time()
{
/* rtcrt(&tact);
   tm.sec  =tact.sec;
   tm.min  =tact.min;
   tm.heur=tact.heur;
   tm.date=tact.date;
   tm.mois=tact.mois;
   tm.an   =tact.an; */
rtcrt(&tm);
}
#endif
/*****************************************
                    GET_HISTORY
  Routine to get a data sample for history
  returns:void
xxxxxxxxxx*/
void get_history()
{   unsigned int a;
    dm[26]+=1;
    dm[87]+=1; /* history count from last download */
    if ( dm[26]>=HISTORY_LENGTH * BANKS )      dm[26]=0;
    a=locate_his( dm[26]);
    dm[17]=0;  /*reset counter for speed readings*/
    ptrhis[a].load    = (char)dm[110];
    ptrhis[a].reading=          dm[111];
    ptrhis[a].revs    = dm[112];
    ptrhis[a].reqrevs=(char)dm[113];
    ptrhis[a].rpm     = (char)dm[114];
    ptrhis[a].h2o     = dm[115];
    ptrhis[a].mode    =          (char)dm[116];
    ptrhis[a].cm      = (char)dm[117];
    ptrhis[a].mois    = (char)dm[118];
    ptrhis[a].date    = (char)dm[119];
#if defined (SBAR)
    ptrhis[a].sbar    =  0xaa;
#endif
    dm[121]           =  dm[120];
}

void save_history()
{   int speed;
    unsigned int t,m;
    dm[120]=600 *((tm.min & 0xF0) >> 4)  + 60* (tm.min & 0x0F) +          10*((tm.sec & 0xF0) >>
4)  + (tm.sec & 0x0F);
    dm[112]=  dm[3];
    dm[113]= (unsigned char)  dm[4];
    if (  hr[9].b[0])
    {  /* if in manuel operation mode */
```

```
            if (hr[9].b[1])
              dm[116] = 0x0e ;
            else
              if (hr[9].b[3])
                    dm[116] = 0x0f ;
              else
                    dm[116] = 0;
        }
        else
              dm[116] = dm[5];
        if ( ch[18].b[15])
            dm[114] = 0,dm[121] = dm[120];
        else
        {
            if (dm[120] > dm[121])
                    t = dm[120]-dm[121];
            else
                    t = dm[120] + 3600-dm[121];
          if (t<3)
          {
            if ((int) dm[17] >0)
                  dm[17]--;
            else
                  dm[17] + + ;
            t=3;
          }
          speed = (int) dm[17];
          dm[114] = (unsigned char) ( (long) (speed<0 ? 0xffff-dm[17] : dm[17]) * 600 / (long) dm[62] /
      (long) t );
        }
        if (speed<0)        dm[116] = 0xd;
      /*  if (ch[18].b[15])   dm[116] = 0xa; */
        if ( /*IN_1*/ ch[9].b[3]) dm[116] + = 0x10; /* value of ch[0].b[1]*/
        if ( /*IN_5*/ ch[9].b[4]) dm[116] + = 0x20; /* value of ch[0].b[5]*/

        /* the next two cases should arise when ch1112 is difu */
        if (tim[20].status) dm[116] + = 0x40;  /* mode 5 entered thru h20 / super 2 sec  */
        if (tim[21].status) dm[116] + = 0x80;  /* mode 5 entered thru mix for 10 seconds */
        dm[118] = 10 * ((tm.mois & 0xF0) > > 4) + (tm.mois & 0x0F);
        dm[119] = 10 * ((tm.date & 0xF0) > > 4) + (tm.date & 0x0F);
        dm[111] = 1000*((tm.heur & 0xF0) > > 4) + 100*(tm.heur & 0x0F) \                    +10*(tm.min
      & 0xF0) > > 4)  + (tm.min & 0x0F);
        dm[115] = dm[10]/10; /* because litres added as 10 = 1 litres */     if (dm[9])
          dm[117] = (unsigned char)  dm[9]*10-(dm[35]*10/dm[60]);
        else
          dm[117] = 0;
        dm[110] = dm[24];
      }
      /*xxxxxxxxxxxxxxxxxxxxxxxxxxxxxxxxxxxxxxxxxxxxxxxxxxxxxxxxxxxxxxxxxxxx  Routine to build a string
      of 35 or less character for the serial port
        inputs: 1 the record number required
              2 a pointer to the string to be modified
      xxxxxxxxxxxxxxxxxxxxxxxxxxxxxxxxxxxxxxxxxxxxxxxxxxxxxxxxxxxxxxxxxxxx*/
      void buildstr(unsigned int num,unsigned char *s)
      {   unsigned char temp[10];
          unsigned int x,x1,h,hismode,hismode1;
          h = ptrhis[num].reading;
          hismode1 = (ptrhis[num].mode & 0xd0);
          hismode  = (ptrhis[num].mode & 0x0f);
          itoa(h,temp,10);
          strcpy(s,(h>999 ? temp : ( (h>99 && h<1000) ? "0" : ((h>9 && h<100) ? "00" : "000" ) ) ) );
          if (h<1000) strcat(s,temp);
          strcat(s," ");
```

```
        if (hismode==0xa)
            temp[0]='S',temp[1]=0;
        else
            itoa((int) hismode,temp,16);
        strcat(s,temp);
        strcat(s,hismode1 & 0xc0  ? (hismode1 & 0x40 ? "h":"m") : " ");
        strcat(s,hismode1 & 0x10 ? "Y":" ");
        strcat(s,hismode1 & 0x20 ? "Z":" ");
        space(s,ptrhis[num].cm,3);
        space(s,ptrhis[num].h2o,4);
        space(s,ptrhis[num].revs,4);
        space(s,ptrhis[num].reqrevs,3);
        space(s,ptrhis[num].rpm,4);
    }
    /*xxxxxxxxxxxxxxxxxxxxxxxxxxxxxxxxxxxxxxxxxxxxxxxxxxxxxxxxxxxxxxxxxxxxxx
      Routine for the Series port to send lines of history data and confirm
    xxxxxxxxxxxxxxxxxxxxxxxxxxxxxxxxxxxxxxxxxxxxxxxxxxxxxxxxxxxxxxxxxxxxxxxxx*/
    void download()
    { unsigned int ser,n,q;
    int sertc;
    unsigned char c,send[60];
    #if defined (TURBO)
        sertc=getccb();
        if (sertc!=-1)
            ser= (unsigned int) ((sertc &0xff) | 0x100);
        else
            ser=0;
    #else
        ecrire(watchdog, 0);
        ser=serin();
    #endif
        if ((ser & 0x100 /* bit8 */ ) != 0) /* Si on a recu du data */
        {           c = ser & 0xFF;
                        if (c==( dm[66]%250) )
                            {
                                dm[66]++; /* ok to go to the next line */
                                ch[18].b[0]=0;
                            }
        }
        if (!ch[18].b[0])
        {   ch[18].b[0]=2;
            q=locate_his( dm[66] );
            make_history(send,ptrhis,q);
            for (n=0;send[n] && (n<60);n++)
            #if defined (TURBO)
                SerialOut(send[n]);
            #else
                serout(send[n]); /* send char string to PC max 60 chars */
            #endif
        }
        else
            ch[18].b[0]--;
    }
    #if !defined(TURBO)
    /*xxxxxxxxxxxxxxxxxxxxxxxxxxxxxxxxxxxxxxxxxxxxxxxxxxxxxxxxxxxxxxxxxxxxxx Routine pour le Port serie
    pour imprimer 35 char's et CR LF si requise
    xxxxxxxxxxxxxxxxxxxxxxxxxxxxxxxxxxxxxxxxxxxxxxxxxxxxxxxxxxxxxxxxxxxxxxxx*//*void rs232set(void) Mise
    en marche du controle du port serie en RS232 */
    /* unsigned int serin(void)          Lecture d'un caractere au port serie */
    /* void serout(unsigned char dat)    Ecriture d'un caractere au port serie*/
    /*xxxxxxxxxxxxxxxxxxxxxxxxxxxxxxxxxxxxxxxxxxxxxxxxxxxxxxxxxxxxxxxxxxxxxx*/
    unsigned char serial_35(unsigned char *s)
    { unsigned int ser,wait;unsigned char n;
```

```
ecrire(watchdog, 0);
ser = serin();          /* Lire le port serie, note that we read for xoff once every line because the print
buffer warns us long before the buffer is actually full  */
if ((ser & bit8) != 0)          /* Si on a recu du data */
{
   if ((ser & 0xFF) == 0x11)
      ch[6].b[2]=1; /* Si recue Xon la variable est mise a 1 */
   if ((ser & 0xFF) == 0x13)
   {
      ch[6].b[2]=0; /* Si recue Xoff la variable est mise a 0*/
      return (13);
   }
}
if ( !ptrtim[30].status || !ch[6].b[2] )
   return(14);
else
{
      for (n=0;*s && (n<36);n++,s++)
            serout(*s); /* On transmet le caractere dans s. */
      if (n<36)
       {
        serout(0xd);
        serout(0xa);  /* On transmet le CR LF. si string est pas complete */
        tim[30].value=dm[88]; /* reset timer due to variable length                                    of time
to output data */
       }
      return(0);
}
  /*          On peut faire plusieur type de routine, mais il est important de verifier
     regulierement si on a recu un Xoff, pour ne pas envoyer de donnees dans
     le vide.
  */
}
#endif
/*xxxxxxxxxxxxxxxxxxxxxxxxxxxxxxxxxxxxxxxxxxxxxxxxxxxxxxxxxxxx
 Routine to extract the correct location and adjust the bank if required
 required : 1 record number
 return   : record and adjust bank for that record
xxxxxxxxxxxxxxxxxxxxxxxxxxxxxxxxxxxxxxxxxxxxxxxxxxxxxxxxxxxxxxxxxxxx*/  unsigned  int
locate_his(unsigned int rec)
{unsigned int bank,location;
#if defined(TURBO)
location=rec;
#else
location=rec%HISTORY_LENGTH;
bank=rec/HISTORY_LENGTH;
switch (bank) {
      case 0: ecrit_16b(portp,bank0);break;
      case 1: ecrit_16b(portp,bank1);break;
      case 2: ecrit_16b(portp,bank2);break;
      case 3: ecrit_16b(portp,bank3);break;
      case 4: ecrit_16b(portp,bank4);break;
      case 5: ecrit_16b(portp,bank5);break;
      case 6: ecrit_16b(portp,bank6);break;
      case 7: ecrit_16b(portp,bank7);break;
      }
#endif
return (location);
}
unsigned char make_cksum(unsigned char *s)
{
unsigned int n; unsigned char cksum=0;
for (n=300;n && *s!=0;s++,n--)
```

```
cksum+=*s;
if (! cksum || cksum==0x13 || cksum==0x11 || cksum == 255)
    cksum=0x55;
return (cksum);
}
void make_history(unsigned char *s,defhistory *ptrhis,unsigned int q)
{ unsigned char temp[10];
s[0]=s[1]=0x11; s[2]=0;
itoa( dm[66],temp,10); strcat(s,temp);strcatv(s,delimit);
if ( dm[66]==0) /* add truck number to transfer data and program mode */
{  itoa( dm[46],temp,10);
   strcat(s,temp);
   strcatv(s,delimit);
   #if defined(SBAR)
      strcat(s,"M=1");
      strcatv(s,delimit);
   #endif
}
itoa((unsigned int) ptrhis[q].load    ,temp,10);strcat(s,temp);strcatv(s,delimit);
itoa((unsigned int) ptrhis[q].reading,temp,10);strcat(s,temp);strcatv(s,delimit);
itoa((unsigned int) ptrhis[q].revs    ,temp,10);strcat(s,temp);strcatv(s,delimit);
itoa((unsigned int) ptrhis[q].reqrevs,temp,10);strcat(s,temp);strcatv(s,delimit);
itoa((unsigned int) ptrhis[q].rpm     ,temp,10);strcat(s,temp);strcatv(s,delimit);
itoa((unsigned int) ptrhis[q].h2o     ,temp,10);strcat(s,temp);strcatv(s,delimit);
itoa((unsigned int) ptrhis[q].mode    ,temp,10);strcat(s,temp);strcatv(s,delimit);
itoa((unsigned int) ptrhis[q].cm      ,temp,10);strcat(s,temp);strcatv(s,delimit);
itoa((unsigned int) ptrhis[q].mols    ,temp,10);strcat(s,temp);strcatv(s,delimit);
itoa((unsigned int) ptrhis[q].date    ,temp,10);strcat(s,temp);strcatv(s,delimit);
#if defined (SBAR)
itoa((unsigned int) ptrhis[q].sbar    ,temp,10);strcat(s,temp);strcatv(s,delimit);
#endif
strcatv(s,make_cksum(s));
strcatv(s,0x13);
}

#include "auto.h"   /* p1234.c */
#include "aut.h"
#include "ahpc.h"
#include "history.h"
#include "str.h"
#if defined (SBAR)
    #include "sbar.h"
#endif
/* *** PART1 is done before the while is begon **** */
void part1()
{
  /******** analog inputs of stroke setup ******************/
  if (!hr[9].b[7])
      hr[8].b[0]=hr[8].b[10]=on,ch[2].b[10]=147;
  /* end of setting of stroke thru analog ***********/
  dm[0]=1, dm[27]=dm[31]=0;
  if (dm[11]<=1000)  dm[11]=1000;  /* minimum setting for speed asjust */
  if (hr[0].b[1]) dm[8]=0;
  if (dm[5]==3) dm[1]=dm[53];
  if (dm[5]==4) dm[1]=dm[54];
  #if defined(SBAR)
  ch[5].b[5]=( dm[62]<=24 ? dm[62]*2 : dm[62] );
  for(n = ch[5].b[5]; n<48 ;n++) sbar[n]=0;
  #endif
} /* end of part1*************************************************** */
/* ****** PART2 ***************************** */
void part2()
{ /* Parametre d'entree : select cnt, minimum cnts, type 1= count 0= rate */
```

```
#if !defined(TURBO)
if ( hr[8].b[8]) /* read frequency with min 500 pulse input from input 10*/
  Highcnt(2,500,0);
if ( hr[9].b[12]) /* read distance input from input 9*/
   Highcnt(1,500,1);
if (!hr[9].b[7] &&! hr[7].b[13])
{ /* change the values of channel 9,10,11 to reflect reading */  if ((dm[99] > = dm[77] && dm[99] < =
dm[78]) || dm[0] = = 0 )
      hr[1].b[11] = on,hr[1].b[9] = hr[1].b[10] = off;
   else
      if (dm[99] < dm[77] && dm[99] > 10) /*10 or less for no sensor*/
hr[1].b[10] = on,hr[1].b[9] = hr[1].b[11] = off;
      else
        if(dm[99] > dm[78] && dm[99] < 252) /* 252 or more shorted sensor */
          hr[1].b[9] = on,hr[1].b[10] = hr[1].b[11] = off;
}
#endif
difu(ptrch,11,10, hr[1].b[10]);
difu(ptrch,11,11, hr[1].b[11]);
difu(ptrch,11, 9, hr[1].b[9]);
/* run stop if not at zero stroke and hr915 is on*/
keep( ch,6,0,( ch[18].b[15] && hr[9].b[15] ), tim[3].status || tim[31].status || hr[1].b[11]);
timer(3,100, ch[6].b[0]);
} /* end of PART2************************* */
/* ******* PART3 ************************* */
void part3()
{
difu(ptrch,10,13,IN_1 || IN_5);
difd(ptrch,10,14,IN_1 || IN_5);
if (IN_1) ch[9].b[3] = on;
if (IN_5) ch[9].b[4] = on;
if (ch[10].b[14] || ch[10].b[13])
      ch[10].b[15] = on;
timer(31,1, ch[12].b[2] ||  ch[14].b[2]);
if (! tim[2].status)
     dm[27] + + ;
else
     dm[26] = dm[27],dm[27] = 1;
timer(2,600,! tim[2].status);
difu(ptrch,7,0, IN_0 );
difd(ptrch,7,3, IN_0 );
out( ch,7,2,( dm[65] >  dm[40] ) );
counter(45,2, ch[7].b[0],( ch[7].b[2] ||  ch[11].b[11]) );
/* page 3.1 */
out( ch,7,1,( ch[7].b[0] &&  dm[65] > dm[58] ) );
if (ch[7].b[0] || ch[7].b[2])
{    dm[18] + + ;
     dm[40] = (unsigned int) (1200000/ (unsigned long)  dm[62] / ((unsigned long)  dm[1] ? dm[1] : 10
) );
     if (  dm[40] < =  dm[58] *2 )
            dm[40] =  dm[58] * 2 ;
     if ( dm[50] > dm[9])
          dm[61] = ( dm[50] - dm[9] + 1) * dm[21] / dm[50] ;
     else
          dm[61] = 0;
     /* page 7.1 check speeds for adjustment*/
      if ( ch[7].b[1])
      {   dm[0] = (unsigned int) ( 600000/ (unsigned long)  dm[62] / ( (unsigned long)  dm[65] /
(unsigned long)  dm[18] ) );
          dm[65] = dm[18] = 0;          }
      if ( ch[7].b[2])
          dm[0] = dm[2], dm[65] = dm[40] * 8 /10, dm[18] = 0  ;
      ch [7].b[6] = ch[7].b[7] = ch[7].b[8] = ch[7].b[9] = 0;
```

```
        if (dm[0]<dm[37])
                ch[7].b[7]=ch[7].b[6]=on;
        else
                if (dm[0]<dm[36])       ch[7].b[6]=on;
        if (dm[0]>dm[39])
                ch[7].b[9]=ch[7].b[8]=on;
        else
                if (dm[0]>dm[38])               ch[7].b[8]=on;
        /* page 3.2 */
        if ( ch[7].b[0])
        {  dm[31]++;
          if (hr[1].b[10])              dm[17]+=1;
          if (hr[1].b[9])               dm[17]-;    }
        if (  ch[7].b[0] &&  hr[1].b[9]  &&  dm[33]< dm[61]  )
                dm[33]+=1;  }
    out( ch,8,3, (dm[0] < (dm[1] * 8/10) || dm[0]<dm[63]) );
    keep( ch,8,1,(  dm[33] >=  dm[61]), hr[1].b[10]);
    if ( ch[8].b[1] &&  ch[7].b[0] &&  dm[85])
        if ( dm[86]/ dm[62]> dm[85])
                dm[85]=0;
        else
                dm[85]-=( dm[86]/ dm[62]); /* remove dm86 10th of a litre per bolt*/
    if (ch[7].b[0] &&  hr[1].b[10])
    {
    if ( dm[33]>0)
        dm[33]-=1;
    else
        dm[32]+=1; }
    /* truely mixing */
    keep( ch,8,2,(ch[7].b[0] &&  dm[33]==0),(!  hr[1].b[10]) );
    /* page 3.3 */
    if ( ch[7].b[0] &&  ch[8].b[2] &&  ch[8].b[5] &&!  ch[8].b[3] &&! tim[22].status)
        dm[34]+=1;
    timer(5,50,! tim[5].status);
    if ( ch[8].b[1] &&  ch[7].b[0] && dm[35]<=dm[60]*10) /* dm[9] */     dm[35]+=1;
    if (tim[5].status)
    {     while ( dm[35]>=dm[60] && dm[9] )
          {   dm[9]-;
            dm[35]-=  dm[60]; /* lower meters reading */
            if (dm[9]==0)                       dm[35]=0;
            ch[10].b[15]=on; /* take history reading */  }
        /* page 3.4 */
          dm[2]= dm[31] * 120 /  dm[62];        dm[31]=0;
          while ( ch[8].b[5] && dm[34]>=  dm[62])
          {           dm[4]+=  1;
           dm[34]=  dm[34]-  dm[62];          }
           while (dm[32]  >= dm[62])
          {  dm[3]++;    dm[6]++;   dm[32]=  dm[32]- dm[62];
              if ( dm[6]>9999)
                  dm[6]=  dm[6] -9999, dm[7]+=1;        }
    }
    out( ch,8,4,( ch[8].b[5] &&  dm[4] >=  dm[14] || tim[33].status ) );
        /* signal end of mix cycle by time or cycles */
    if ( ch[8].b[4])
    { save_history();
     get_history();
     if ( dm[5]==4 ||  dm[5]==5 || ( dm[5]==3 &&  dm[44]==0) || ( dm[5]==2 &&  dm[43]==0) )
         dm[5]=6, water_added =0;
     if ( dm[5]==3 )        dm[5]=4;
     if ( dm[5]==2 )        dm[5]=3; }
    if ( (tim[5].status ||  ch[8].b[4]) && dm[5]==6 && ( dm[8]*dm[60] /2 >=
        (dm[9] ? dm[9]*dm[60]-dm[35] : 0)) )     dm[5]=7;
    } /* END OF PART3*****************************  */
```

```
/* ****** PART4 INPUT DETERMINATION********** */
void part4()
{ /* page 4.0 */
timer(0,1,(IN_2 || IN_3 || IN_4 || IN_6 || IN_7 ));
timer(1,9,(IN_3 || IN_4)&&! hr[1].b[9]);
difu(ptrch,11,1,IN_2 &&! hr[1].b[9]);
out( ch,11,13,( tim[1].status && IN_3 && ( hr[0].b[7] && (! hr[9].b[10] || ! dm[85])))));
difd(ptrch,11,3,ch[11].b[13]);
out( ch,11,14,( tim[1].status && IN_4 &&! hr[1].b[14]));
difd(ptrch,11,4,ch[11].b[14]);
/* page 4.1 */ out( ch,11,06,tim[0].status && IN_6 );
out( ch,11,07,tim[0].status && IN_7 );
timer(11,15,tim[0].status && IN_6 && hr[1].b[3] && hr[1].b[10] );
/* signal to go to mode 5 because mbx hit for more that 10 sec */
timer(21,100,( IN_6 && hr[1].b[10] && ( hr[0].b[6] || hr[0].b[7] \
    || hr[0].b[3] || hr[0].b[4] || hr[0].b[5])) );
timer(20,32, ((ch[12].b[5] && hr[8].b[7]) || ch[14].b[5]) && ! hr[9].b[0] ); /* h20/super for 3.2 seconds
*/
out( ch,11,2,( (tim[22].status || tim[20].status)
            && ( hr[0].b[6] || hr[0].b[7] || hr[0].b[3]
                || hr[0].b[5] || hr[0].b[4] ) ) );
/* page 4.2 */
difu(ptrch,11,12,( ch[11].b[2] || tim[21].status) ) ;
/* 1505 or 1705 is from keyboard*/
difu(ptrch,6,12,( ch[11].b[13] || ch[11].b[14] || tim[11].status \
    || tim[21].status || IN_2 ) );
keep( ch,6,14,ch[6].b[12] ,tim[14].status);
timer(14,12, ch[6].b[14]); /* beep on data input */
timer(25,60, ch[6].b[7]); /* only in C for stop function max time is stop fn */
keep( ch,6,7,tim[31].status,
        ( (hr[1].b[11] && hr[8].b[9] /* if hr809 is on then hr111 will end stop function*/ )\
         || tim[25].status || IN_6 || IN_7) );
/* page 4.3 */
timer(4,150,( ! hr[1].b[3] && hr[1].b[10] ) );
/* keep automatic hr103 note that hr103 may be turned on if kbstat==17 and not in hr103 and
dm35==dm60*10 */ keep( hr,1,3, ( ! hr[9].b[0] && ( ch[11].b[3] || ch[11].b[4] \ ||
tim[21].status || tim[4].status || ch[9].b[10] )), (tim[11].status || ch[18].b[15] || ch[9].b[9]
|| tim[31].status || tim[24].status) );
timer(24,1200,dm[0]==0); /* handle the event that the drum is really stopped */
difu(ptrch,10,3, hr[1].b[3]);
difd(ptrch,10,4, hr[1].b[3]);
/* page 4.4 NEXT STEP */
if ( ch[11].b[12] )
   dm[15]= dm[5],dm[5]=5, dm[13]=dm[4];
keep( hr,1,15,( ch[11].b[12] && ( hr[0].b[3] || hr[0].b[4])), \ ( ch[10].b[0] && ( hr[0].b[6] ||
hr[0].b[7])) ); /* water added in step 3 or 4 */
  if ( ch[11].b[12] && hr[1].b[15]) dm[13]= dm[4];
if ( ch[11].b[3] && hr[0].b[7])
   { dm[13]= dm[3], dm[100]+= dm[8], dm[3]=0, dm[15]=7;
     dm[5]=1;  dm[24]+=1;
     if ( dm[24]>255)  dm[24]=1;  }
/* page 4.5 OOP'S FUNCTION */
if ( ch[11].b[4] || ch[10].b[2])
{ water added =0;  dm[5]= dm[15];
  if ( hr[0].b[1])
  { unsigned int oops_adjust;
    if ( dm[24]==1)
       dm[24]=255;
    else
       dm[24]-=1;
    oops_adjust=locate_his( dm[28]);
    ptrhis[oops_adjust].load= dm[24];
    ptrhis[oops_adjust].mode= dm[5];
```

```
        dm[3] + = dm[13];
        dm[4] =          dm[8] = dm[9] = 0;    }
      if ( hr[0].b[2])
       dm[3] = dm[13],dm[4] = 0;
      if ( hr[1].b[15] || dm[15] = = 5)
        dm[4] = dm[4] + dm[13]; }
    #if defined(SBAR)
   /****************** sbar readings ****************************/ if (ch[7].b[0] || (dm[62] < = 24
   && ch[7].b[3]) )
   {    if ( ihr[1].b[3] )            hr[6].b[1] = ch[5].b[5] + 10;
        /* use dm[0] if in emulator mode else use true value*/
        #if !defined (TURBO)
        ch[2].b[1] = Uwadc(can1);
        #endif
        sbar[hr[6].b[0]] = ( hr[7].b[13] ? dm[128] : ch[2].b[1] );
        hr[6].b[0] + + ;
   /* add reading if less than minimum readings and speed within range */
        if (ch[7].b[7] = = 0 && ch[7].b[9] = = 0 && hr[6].b[1])     hr[6].b[1]--;
        if (hr[6].b[0] > = ch[5].b[5])                    hr[6].b[0] = 0;
        for(dm[122] = n = 0;n < ch[5].b[5];n + +) dm[122] + = sbar[n];
        dm[122] = dm[122]/((unsigned int) ch[5].b[5] );
        if ( kbstat = = 17 && hr[6].b[1] = = 0 && dm[35] > = dm[60]*10 ) /* adjust zero value for sbar */
          dm[123] = dm[122],hr[6].b[2] = off;/* reset adjust zero flag*/
        if (dm[123] > = dm[122] + 3)
                hr[6].b[2] = on; /* zero needs to be adjusted */
   /*********************** add sbar.c ****************************/   pr = (long) (dm[122]-dm[123])
   * 140 * (long)dm[98]/1000; /* 1961 /140 */
     dm[125] = (unsigned int) pr;
     if (dm[125] > = 4500) /*negative reading therefore presure = 0 */
          dm[125] = pr = 0;
      maxm = 0,minm = 750;
      for (n = 130;dm[n];n + = 3)
      {  if(dm[n] > maxm) maxm = dm[n];
         if(dm[n] < minm) minm = dm[n];     }
      m = mr = (dm[9] ? (dm[9]*10-dm[35]*10/dm[60]) : 0);
      if (minm > = mr)          m = minm;
      if (maxm < mr)            m = maxm-1;
      for (hmsel = maxm,lmsel = minm,n = 130;dm[n];n + = 3)
      {   if (dm[n] < hmsel && dm[n] > = m) hmsel = dm[n];
          if (dm[n] > lmsel && dm[n] < = m) lmsel = dm[n];     }
      /* find pressure and slump readings from table */
      maxp = 0,minp = 5000;
      for (n = 130;dm[n];n + = 3)
      { if(dm[n + 1] > maxp && dm[n] = = hmsel) maxp = dm[n + 1],s1 = dm[n + 2];
        if(dm[n + 1] < minp && dm[n] = = hmsel) minp = dm[n + 1],s2 = dm[n + 2];}
      p = pr;
      if (minp > = pr)          p = minp + 1;
      if (pr > maxp)            p = maxp-1;
      for (h1 = maxp,h2 = minp,n = 130;dm[n];n + = 3)
      {   if (dm[n + 1] < h1 && dm[n + 1] > = p && dm[n] = = hmsel) h1 = dm[n + 1],s1 = dm[n + 2];
          if (dm[n + 1] > h2 && dm[n + 1] < = p && dm[n] = = hmsel) h2 = dm[n + 1],s2 = dm[n + 2];     }
      /* find pressure for imeter select */
      maxp = 0,minp = 5000;
      for (n = 130;dm[n];n + = 3)
      { if(dm[n + 1] > maxp && dm[n] = = lmsel) maxp = dm[n + 1],s3 = dm[n + 2];
        if(dm[n + 1] < minp && dm[n] = = lmsel) minp = dm[n + 1],s4 = dm[n + 2];}
      p = pr;
      if (minp > = pr)          p = minp + 1;
      if (maxp < pr)            p = maxp-1;
      for (l3 = maxp,l4 = minp,n = 130;dm[n];n + = 3)
      {   if (dm[n + 1] < = l3 && dm[n + 1] > = p && dm[n] = = lmsel) l3 = dm[n + 1],s3 = dm[n + 2];
          if (dm[n + 1] > = l4 && dm[n + 1] < = p && dm[n] = = lmsel) l4 = dm[n + 1],s4 = dm[n + 2];     }
       /* high line */
```

```
        if (h1 = = h2)
            hs = (long) s1;
        else
            hs = (long) s1 + ((long)s2-(long)s1)*(pr-(long)h1)/((long)h2- (long) h1);
        if (l3 = = l4)
            ls = (long)s3;
        else
            ls = (long)s3 + ((long)s4-(long)s3)*(pr-(long)l3)/((long) l4-(long) l3);
        if (hs = = ls)
            dm[126] = (unsigned int) ls;
        else
            dm[126] = (unsigned int) (ls + ((long) mr-lmsel)*(hs-ls)/( hmsel-lmsel));
    /* endof sbar.c ***********************************************/
    } /******* sbar readings ************************/
    #endif
    } /* END OF PART4 ********** */

    #include "auto.h"  p91011.c
    #include "aut.h"
    #include "ahpc.h"
    #include "history.h"
    #include "listdm.h"
    #include "str.h"
    /* *************** part9 *** water calculations ********** */
    void part9()
    {
    if(ch[11].b[1])
    { long meterleft = (long) dm[9] ? (dm[9]*10-dm[35]*10/dm[60]): 0;
      water_time = (unsigned int)( (unsigned long) (dm[48]) * (meterleft > 0 ? meterleft: 10) / (unsigned long)
    (dm[47])/10 );}
    timer(13,water_time,(IN_2  &&!  hr[1].b[9] && !  ch[11].b[1] && ! tim[13].status) );
    keep(ch,6,13,tim[13].status,tim[19].status);
    timer(19,10,ch[6].b[13]);
    /* page 9,1 */
    timer(22,25,IN_2  &&!  hr[1].b[9]);   /* water being added and not discharging */
    timer(23,10,(IN_2 &&! tim[23].status &&! hr[1].b[9]) );
    if (tim[23].status )
    {     water_added + =  dm[47];
          if ( dm[85] < 4000 &&!  hr[9].b[0])  dm[85] + = dm[47];
          dm[10] + = dm[47]; }
    keep(hr,1,5,hr[0].b[6],ch[11].b[3] );
    dfu(ptrch,11,8,hr[1].b[5]);
    if (ch[11].b[8])
          dm[10] = 0; /* reset water to zero for client reading */
    } /* ************* end of part9 ************************** */
    /* *************   part 10      ************************ */
    void part10()
    {
    full1 = 0,full2 = 0;
    if (!ch[5].b[2])
    {  /* note that reset of 502 to 255 happens automaticly because 0-1 = 255 */
      if (ch[8].b[14])    /* flip flop every 2 seconds */
          ch[8].b[14] = off;
        else
          ch[8].b[14] = on; }
    ch[5].b[2]- = 1;
    keep(ch,9,0,(kbstat > 1),( tim[10].status || !kbstat || kbstat > 8900              ||      ch[15].b[7]   ||
    kbstat = = 9 || kbstat = = 111 || kbstat = = 90            || kbstat = = 11 ||kbstat = = 13 || kbstat = = 14 ||
    kbstat = = 17)); timer(10,450,ch[9].b[0] );
    timer(16,200,kbstat = = 14 && hr[6].b[1] = = 0);
    if ( kbstat > 9920 || !ch[5].b[0] || ch[6].b[9] || ch[6].b[10])
    {                                  /* kb or con button hit */
    if (kbstat < 9920)
       ch[5].b[0]  = 40;
    else
       ch[5].b[0]  = 1; /* time for screen */
```

```
    if ( hr[1].b[11])
      line1[0]='S';
    else
    {   if ( hr[1].b[9])
          line1[0]='D';
      else
      {  if (hr[1].b[3])
            line1[0]='A';
        else
            line1[0]='M';    } }
    line1[1]=line3[0]= dm[5]+48;
    if (hr[1].b[14])
        line1[2]=32;
    else
        line1[2]=111;
    line1[3]=58; line1[4]=0; line3[1]=0;
    if ( !kbstat &&!  ch[14].b[12] &&!  ch[14].b[13] \
            &&!  ch[14].b[15] &&!  ch[14].b[11] &&!  ch[12].b[6])
    {   if (ch[8].b[5])
        { if ( ch[8].b[3] || tim[20].status)
          {   strcat(line1,tim[20].status ? " H20 / SUPER" :
              (hr[9].b[13] ?  "RPM TOO SLOW" : "RPM TROP BAS") );
              strcpy(line3,tim[20].status ? "h20 " : "5mr" ); }
          else
          {         strcat(line1,ch[8].b[14] ? ( hr[9].b[13] ? " LOAD # ": "Voyage # ") : " Revs = ");
          itoa( ch[8].b[14] ? dm[24] : dm[3] ,temp,10);
          strcat(line1,temp);
          itoa( dm[14]-dm[4],temp,10);
          strcat(line3,temp);        }
          strcpy(line2,"MIX: ");
          itoa( dm[4],temp,10);
          strcat(line2,temp);
          strcat(line2," / ");
          itoa( dm[14],temp,10);
          strcat(line2,temp);     }
        if ( (hr[0].b[6] || hr[0].b[7]))
        { if(hr[0].b[6] || (hr[1].b[9] && hr[0].b[7]))
                strcpy(line2,hr[9].b[13] ? " READY TO POUR" : " BETON EST PRET");
          else
            if (ch[11].b[13])
                strcpy(line2," *** CHARGE ***");
            else
            {
                if ( dm[85] && ch[8].b[14] /* flip flop */)
                {         itoa( dm[85]/10+1,temp,10);
                          strcpy(line2,temp);
                          strcat(line2,hr[9].b[13] ? " L in drum" :  " L dans drum"); }
                else
                          strcpy(line2, "MODE>2sec>CHARGE");
            }
          strcat(line1,ch[8].b[14] ? ( hr[9].b[13] ? " LOAD # ": "Voyage # ")   : " Revs = ");
          itoa( ch[8].b[14] ? dm[24] : dm[3] ,temp,10);
          strcat(line1,temp);
          itoa( dm[3],temp,10);
          strcat(line3,temp);       }
        if (hr[9].b[0])
        { strcpy(line3,"E");
         strcpy(line1,hr[9].b[1] ? "LIMIT SWITCH " :(
                    hr[9].b[3] ? "SWITCH ALIGNMENT" :
            (hr[9].b[13] ? "COMPUTER IN" : "ORDINATEUR EN") ));
       strcpy(line2, hr[9].b[13] ? "MANUEL MODE" : "MODE MANUEL");}     if (hr[9].b[6])
            strcpy(line2,(hr[9].b[13] ? "PROBLEM KEYBOARD":"PROBLEM CLAVIER"));
        if (hr[9].b[5])      strcpy(line3,"Econ");
```

```
    }
    else
    {
      line2[0]=0; /* set to zero for house keep purposes */
      if ( ch[12].b[6] && ! kbstat)
      {   strcat(line1," HELP IS NOT");
          strcpy(line2,"AVAILABLE NOW!");    }
      if (kbstat==1)
      {   strcpy(line2,(!kbcnt &&! dm[8]) ? (hr[9].b[13] ? " Enter Volume" : " Entrer volume")
                                          : (ch[6].b[14] ? (hr[9].b[13] ?"ENTER if CORRECT":"ENTER
si CORRECT"):(hr[9].b[13] ? "ESC to MODIFY" : "ESC pour CHANGER")) );.
          itoa(((kbcnt || dm[8]) ? ( dm[8] ? dm[8] : atoi(kbstr)) : dm[50]*14/10 ),temp,10); /* convert dm8
or 50 */
          strcat(line1, (kbcnt || dm[8]) ? " " : " 1-");
          strcat(line1,temp);
          strcat(line1," Metres");    }
       if (kbstat==111)
       {    if (kbcnt)
            {
                 strcpy(line1,hr[9].b[13] ?"MODE for ":"MODE si ");
                 strcat(line1,kbstr[0]=='1' ? "BATCH" : (kbstr[0]=='3' ? "PREMIX":"SPECIAL") );
                 itoa( dm[24],temp,10);
                 strcpy(line2,(hr[9].b[13] ? "ESC=MODIFY #" : "ESC=CHANGER #"));
                 strcat(line2,temp);              }
            else
            {strcpy(line1,"1=BATCH 3=PREMIX");
                 strcpy(line2,ch[6].b[14]   ?   (hr[9].b[13]?"5=SPECIAL   PREMIX":"5=PREMIX
SPECIAL"):(hr[9].b[13] ? "ESC for METERS" : "ESC pour METRES"));    }    }
      if (kbstat==2)
      {strcpy(line1,"1=Info 2=control");
         strcpy(line2,"3=Functions ");    }

      if (kbstat==14)
       {if (hr[6].b[1]==0 )
          {          if (dm[126]>=32767)
                     {          dm[124]=0-dm[126];    ch[5].b[6]=on; }
                     else
                                dm[124]=dm[126],ch[5].b[6]=off;
                     dm[124]=(dm[124]+5)/10*10;
                     itoa(dm[124],temp,10);
                     strcpy(line2,(ch[5].b[6] ? "MM= -": "MM=  "));
                     strcpy(line3,(ch[5].b[6] ? "-"    : "*"    ));
                     strcat(line3,temp); strcat(line2,temp);      }
          else
          {                     strcpy(line2,(hr[9].b[13]) ? "Please wait" : "Attendre S.V.P.");
                     strcpy(line3," CAL");      }      }
          else
          {          strcpy(line2,(hr[9].b[13]) ? "not available" : "pas disponible");      strcpy(line3,"no S");
       }   }
       /* note that kbstat==16 is found with ==7)*/
       if (kbstat==17)
       {strcpy(line1,"CALIBRATE SBAR");
          strcpy(line2,dm[35]<dm[60]*10 ? " DISCHARGE" : (hr[9].b[13] ? "Please wait" : "Attendre S.V.P.")
);
          if ( dm[35] >= dm[60]*10 && hr[1].b[3]==off )hr[1].b[3]=on;
          if (hr[6].b[1]==0 && dm[35]>=dm[60]*10)
             kbstat=kbcnt=kbstr[0]=0;      }
       if (kbstat==18)
       {strcpy(line1,"1=Zero slump");
       strcpy(line2,hr[9].b[13] ? "3=time 4=date": "3=heure 4=date");}    if (kbstat==90)
        {strcpy(line1,"1=Test 2=Prt Dm");
         strcpy(line2,"3=Modify Data  ");    }
         if (kbstat==9550)
        {strcpy(line1,"OUTPUT TO DISK"); strcpy(line2,"LINE #");
           itoa( dm[66],temp,10);   strcat(line2,temp);    }
```

```
if (kbstat==99)/*output system condition forfirst 45 secs */
{#if !defined(TURBO)
    dm[75]=Uwadc(can5);     /* read battery level  */
  #endif
  itoa(dm[75],temp,10);
  if ( dm[75] > dm[76])
  {       strcat(line1,hr[9].b[13] ?" BAT. OK ":" PILE OK ");
          if ( dm[67] > HISTORY_LENGTH * BANKS / 10 * 8)
                  strcpy(line2," DOWNLOAD LOG");
          else
                  strcpy(line2,"ESC  for  Menu");  }
  else
  {       strcpy(line2,hr[9].b[13] ? "CHANGE BATTERY":"CHANGER PILE");
          strcpy(line1,"**URGENT** B=");          }
  strcat(line1,temp);    }
if  (kbstat==5900 || kbstat==5910)
{  strcpy(line1,"Pass code:");       itoa( dm[22],temp,10);
  strcat(line1,temp);       strcpy(line2,"pass #:");
  strcat(line2,kbstr);   }
if (kbstat==9900 || kbstat==9902)
{  strcpy(line1,"enter DM ");       strcat(line1,kbstr);
  strcpy(line2,"dm 0 to dm 110 ");    }
if (kbstat==9903 || kbstat==9901)
{   unsigned char x;
    if (dm[68]<maxxdm)
    {  for (x=0;x<16;x++)
            line1[x]=xdm[  dm[68] ].e[x];
      line1[16]=0;            }
    else
      strcpy(line1,"Not defined");
    strcpy(line2,"D");                    itoa( dm[68],temp,10);
    strcat(line2,temp);          strcat(line2,":");
    itoa( dm[( dm[68])],temp,10);    strcat(line2,temp);
    strcat(line2,">");           strcat(line2,kbstr);    }
if (kbstat==9910)
{  strcpy(line1,"enter hr ");  strcpy(line2,"format xxx");
  strcat(line1,kbstr);    }
if (kbstat==9911)

{  itoa( dm[67],temp,10);       strcpy(line1,"Hr ");
  strcat(line1,temp);       itoa( dm[68],temp,10);
  strcat(line1,temp);       strcat(line1," =");
  itoa(hr[( dm[67])].b[( dm[68])],temp,10);
  strcat(line1,temp);       strcpy(line2,"value:");
  strcat(line2,kbstr);   }
if (kbstat==9920)
{  strcpy(line1,"enter ch "); strcpy(line2,"format xxxx");
  strcat(line1,kbstr);    }
if (kbstat==9921)
{  itoa( dm[67],temp,10);       strcpy(line1,"ch ");
  strcat(line1,temp);       itoa( dm[68],temp,10);
  strcat(line1,temp);       strcat(line1," =");
  itoa(ch[( dm[67])].b[( dm[68])],temp,10);
  strcat(line1,temp);       strcpy(line2,"value:");
  strcat(line2,kbstr);   }
```

```
if (kbstat = =9930)
{ strcpy(line1,"enter ch "); strcpy(line2,"format xx");
  strcat(line1,kbstr);   }
if (kbstat = =9931)
{  for (n=0;n<16;n++)
     {  line1[n]=ch[( dm[68])].b[n]+48;
        line2[n]=ch[( dm[68]+1)].b[n]+48;          }   }
if (kbstat = =9940)
{ strcpy(line1,"enter Tim: "); strcpy(line2,"0 - 39 only");
  strcat(line1,kbstr);   }
if (kbstat = =9941)
{ itoa( dm[68],temp,10);
  strcpy(line2,"Tim:");      strcat(line2,temp);
  strcat(line2," = ");      itoa(tim[(dm[68])].value,temp,10);      strcat(line2,temp);      strcat(line2,":");
  strcat(line2, tim[( dm[68])].status ? " ON" : " OFF"); }
if (kbstat = =9950)
{ strcpy(line1,"enter Cnt: "); strcpy(line2,"0 - 50 only");
  strcat(line1,kbstr);   }
if (kbstat = =9951)
{ itoa( dm[68],temp,10);      strcpy(line2,"Cnt:");
  strcat(line2,temp);      strcat(line2," = ");
  itoa(cnt[( dm[68])].value,temp,10);
  strcat(line2,temp);      strcat(line2,":");
  strcat(line2,  cnt[( dm[68])].status ? " ON" : " OFF"); }
if (kbstat = =9960)
{ strcpy(line1,"hex ?:"); strcpy(line2,"format 0xNNNN ");
  strcat(line1,kbstr);   }
if (kbstat = =9961)
{  unsigned char string[15],n;   unsigned char *address;
     address= dm[68];      itoa( dm[68],temp,16);
     strcpy(line1,temp);      strcat(line1,":");
     for(n=1;n<9;n++)
     {   itoa( (unsigned int) *address, string, 16);
           if (n<4)
           { strcat(line1,string); strcat(line1," "); }
           else
           {   if (n= =4)
                     strcpy(line2,string);
                 else
                     strcat(line2,string);
                 strcat(line2," ");   }
           address++;    }    }
} /* end of if kbstat is on */
if (tim[1].status && IN_4 &&! hr[1].b[14])
     strcpy (line2,"**** OOP's ****");
if ( ch[0].b[2] &&!  hr[1].b[9])
```

```
{    strcpy(line3,"c");
     itoa(  (int)( (unsigned long) (water_added) *100 /(unsigned long) dm[48]  / (dm[9] ?(unsigned
long) dm[9] : 1) ),temp,10);  strcat(line3,temp); }
if (line3[1] = =0)
        line3[3] = line3[2] = line3[1] = 32;
else
{       if (line3[2] = =0)
        {  line3[3] = line3[1];     line3[1] = line3[2] = 32;    }
        else
        {   if (line3[3] = =0)
            {line3[3] = line3[2]; line3[2] = line3[1]; line3[1] = 32;} }}
line1[16] = line2[16] = line3[4] = 0;
/* fill in blanks if new string shorter than old string,
   and also check sum for new string to be output        */
for (n=0;n<16;n++)
{if (line1[n] = =0) full1 = on;
 if (line2[n] = =0) full2 = on;
 if (full1)                line1[n] = 32;
 if (full2)       line2[n] = 32; }
} /*end of kbstat>9900 etc */
if ( strcmp(oldline1,line1) || strcmp(oldline2,line2) || tim[2].status)
     ch[7].b[10] = on;
else
     ch[7].b[10] = off;
if ( strcmp(oldline3,line3) ||  ch[10].b[3] ||  ch[10].b[4] || tim[2].status)
     ch[7].b[11] = on;
else
     ch[7].b[11] = off;
if ( ch[7].b[10] || ch[7].b[11] )
   outlcds();
ch[5].b[0]--; } /* end of part10 screen output******/
void part11()
{timer(29,100, ( !hr[1].b[9] &&! hr[1].b[10] &&! hr[1].b[11] &&! hr[9].b[11]) );
keep( hr,9,1,tim[29].status,ch[9].b[11]);
/*page 11.1 */
timer(27,150,(hr[1].b[11] && dm[2] > =25 &&! hr[9].b[11])  );
keep(hr,9,3,tim[27].status,ch[9].b[11]);
/* error check routine for rear console  If a button is held for   more than 5 second we can assume that
an error might of    occured.    In this case we disconnect (kbentry1) the console until no button has
been hit for atleast 1 second to show that every thing seem to of returned to normal              */
timer(34,95,ch[10].b[12]);
if (hr[9].b[5] && tim[35].status)   /* archive error */
     hr[8].b[5] + = 1;              /* add bit to show that tim34 and ch1405     was on and decide about
the 10 seconds to = h20/super  button */
keep(hr,9,5,tim[34].status,tim[35].status);
out(ch,10,2,hr[9].b[5] && ch[14].b[5] &&! hr[7].b[0]); /* oops if console error */
timer(35,130,hr[9].b[5] &&! ch[10].b[12]);
/* end of error check routine for rear console
   begining of error check routine for main kb */
timer(40,200,ch[12].b[15]);
if (tim[41].status && hr[9].b[6])/* archive error */
hr[8].b[6] + = 1;
keep(hr,9,6,tim[40].status,tim[41].status);
timer(41,30,hr[9].b[6] &&! ch[12].b[15]);
keep(hr,9,0,( tim[27].status /*|| tim[28].status*/ || tim[29].status),ch[9].b[11]);
dlfu(ptrch,9,9, hr[9].b[0]);
dlfd(ptrch,9,10,hr[9].b[0]);
if (ch[9].b[9])   dm[5] = 7;
if (ch[9].b[10])  dm[85] = dm[8] = dm[9] = dm[10] = 0 , dm[5] = 7;
keep(ch,9,14,ch[9].b[9] &&!  ch[18].b[15],tim[12].status);
timer(12,50,ch[9].b[14]); /* stroke pump on error for 5 seconds*/ /* page 11.2 error beep */
keep(ch,6,15, ( ((ch[18].b[15] && hr[0].b[0]) || ch[9].b[10])  ||      (tim[0].status && ( (tim[5].status
&& ch[9].b[0])                  || ( IN_7  && hr[1].b[3]   )  ||
```

```
                    ( IN_3  && ( hr[1].b[9] || hr[0].b[2] ||  hr[0].b[3] ||  hr[0].b[4] || hr[0].b[5]
|| hr[0].b[6] ||
(hr[0].b[7] && dm[85]  &&  hr[9].b[10]) ||
                                        (hr[0].b[1] && !dm[8] ) ) ) ||
( IN_4  &&  hr[1].b[14] )))),(tim[18].status &&! tim[0].status)); timer(18,20,ch[6].b[15]);
/* page 11.3 output beep */
out(ch,1,4,((ch[6].b[13] &&! tim[19].status)   ||
          ch[6].b[14]                  ||
          (ch[6].b[15] && kbstat<2) &&! tim[18].status        ||
          ch[9].b[14] || tim[20].status  )  );
if (ch[1].b[4])
{    if (ch[6].b[5] = =0)
          ch[6].b[5]=8;
     else
          ch[6].b[5]--; }
else
     ch[6].b[5]=off;
/* error detection routine for rear console */
} /* end of part11 error detection */
#define MAIN  /* auto.c */
#include "auto.h"
#include "str.h"
#include "listdm.h"
#include "aut.h"
#include "shpc.h"
#if defined(TURBO)
#include <conio.h>
#include <stdio.h>
#include "serial.h"
#include "serial1.h"
#endif
#include "history.h"
/* ********** MAIN ******************************  */
int main(void)
{
#if defined (TURBO)
     unsigned char menu[50];
     clock_t start, end,diff_time;
#else
   static unsigned int *ptrstack,ck_stack=0;
   ecrire(watchdog, 0);
#endif
ptrch=ch;
ptrhr=hr;
ptrdm=dm;
ptrtim=tim;
ptrcnt=cnt;
#if defined(TURBO)
   start = clock();
    ch[6].b[1]=on;
   window (1,1,80,25);
   textcolor(WHITE);
   textbackground(BLACK);
   clrscr();
   gotoxy(1,25);
   printf("f9900=dm xxx f9910=hr xxx f9920=ch xxxx f9930=chs   f9940=tim xx f9950=cnt xx");
   ptrhis=calloc(HISTORY_LENGTH*BANKS,sizeof(defhistory));
/* getsetint();  get and set interrupt not used but available */    getdata();  /* to emulate the ram */
   dm_names();
   strcpy(menu,"        ");
   strcatv(menu,0x19);
   strcat(menu,"    ");
   strcatv(menu,0x18);
```

```
strcat(menu," STOP MODE OOPS Sbar ? Fn ESC ENTER");
window (1,21,56,24);
textcolor(BLACK);
textbackground(LIGHTGRAY);
clrscr();
gotoxy(1,1);
cprintf("Fn key F1 F2 F3 F4 F5 F6 F7 F8 F9 F10\r\n");
cprintf("%sSHIFT 1 2 3 4 5 6 7 8 9 0\r\n",menu);
strcpy(menu,"ALT F1 F2 F3 F4 C D H20? H20 Cd Cu");
menu[28]=menu[48]=0x19;
menu[33]=menu[54]=0x18;
cprintf("%s",menu);
window (1,1,80,25);
textcolor(WHITE);
textbackground(BLACK);
hr[7].b[13]=on; /* on for emul to work */
        /* serial port setup */
        if (SetSerial(port,dm[89],parity,bits, stopbits)!=0)
        { fprintf(stderr, "serial port setup error \n");
            getch(); /* stop for error reading */        }
        initserial();
#else
  ecrire(watchdog, 0);
  initall();
  ecrire(watchdog, 0);
  ptrstack=0x00c4;
  ck_stack=*(ptrstack);
  ch[6].b[1]=panne();
  if ( ! ch[6].b[1] )
        dm[74]+=1;   /* Add 1 to counter of watchdogs */
  else
       kbstat=99; /* to output condition of the battery */
  ptrhis=0x4000;
  if (dm[41]!=1365 )
  {  ecrire(watchdog, 0);
     rtcwt(&teinit); /* Initialisation du RTC. */
     init_dm();      dm_names();     }
  outinsicd(0x01);     /* init screen */
  initaf();   adjust_in_out();
#endif
oldline1[0]=oldline2[0]=oldline3[0]=0; /* reset line to null */
for(n=0;n<17;n++)
{
if (n<=4)
  line3[n]=0;
line1[n]=line2[n]=0; }
for(n=0;n<maxch;n++)
      for(l=0;l<=15;l++)
        { ch[n].b[l]= ch[n].status[l]=off;}
for(n=0;n<maxtimers;n++)
{tim[n].value=0; tim[n].status=tim[n].count=0; }
for(n=0;n<=47;n++)
cnt[n].value=cnt[n].count=0,cnt[n].status=0;
kbstat=99; /* to output condition of the battery and not panne */
get_history(); /* inscribe last reading before shut down */
get_time();
save_history();
/* at start up replace dm116 with 0xa and high bits*/
ch[18].b[15] = (unsigned char) dm[116]; /*save reading and replace after get history */
dm[116] = (dm[116] & 0x00f0 )+0xa;
get_history();
dm[116]=ch[18].b[15]; /* replace dm[116] after gethistory */
ch[18].b[15]=on;  /* initialize 1815 first scan */
```

```
part1();
while (TRUE)
{
#if !defined(TURBO)
  ecrire(watchdog, 0);
  adjust_in_out();
  kbentry1();
#else
  kbentry();   end = clock();
  if (end>start)
  { #if defined(TURBO) /* OUTPUT EACH SCAN IN TURBO*/
      if (ch[0].b[15])
        status(ptrch);
      else
        stat(ptrch);
    #endif
        diff_time=55*(end-start);
        dm[84] += diff_time; dm[64] += diff_time;
        dm[65] += diff_time; start=end;   }
#endif
ck_kb();
#if defined EMUL
if ( hr[7].b[13] ) emul(); /* produit des pulses pour emulation de drum */
#endif
IN_0 = ( ch[0].b[8]);
IN_1 = ( ch[0].b[1]); /* extra input for brakes or conveyor.*/
IN_2 = ( ch[0].b[2]);
IN_3 = ( ch[12].b[3] && ! hr[9].b[0]);
IN_4 = ( (ch[12].b[4] && (kbstat<=1 ||kbstat==111) &&! hr[9].b[0] ) );
IN_5 = ( ch[0].b[5]); /* extra input for brakes or conveyor */
IN_6 = ( ch[0].b[3] ||  ch[14].b[0] ||  ch[12].b[0]);
IN_7 = ( ch[0].b[4] ||  ch[14].b[1] ||  ch[12].b[1]);
/* IN_8 = ( 0 ) ;*/
/* part1() is done before start of the loop */
  part2();
  part3();
  part4();
  part5();
  part6();
  part7();
  part8();
  part9();
  part10();
  part11();
#if !defined(TURBO)
  ecrire(watchdog, 0);
#endif
dlld(ptrch,6,8,ch[12].b[15] || ch[13].b[15] || ch[12].b[14] || ch[1].b[4] );
 #if defined(TURBO)
    if ( ch[6].b[5]==8 || ch[6].b[10] )
     sound(2000);
     if (ch[6].b[9])
     sound(3880);
     if (ch[6].b[8]  || ch[6].b[5]==4)
     nosound();
 #else
    if ( ch[6].b[5]==8 || ch[6].b[10] )
        buzzon();
     if ( ch[6].b[5]==8 || ch[6].b[9])
    { console_run();  /* La frequence d'operation du Uwire bus */
        buzcon();
        console_off();  /* On revient a a frequence d'operation  */   }
if (ch[6].b[8]|| ch[6].b[8]==4 )
```

```
        { console_run();
    /* La frequence d'operation du Uwire bus */
          buzcof();
      console_off(); /* On revient a a frequence d'operation  */    buzoff();      }
  #endif
  if (ch[10].b[4]  || ch[8].b[5] )
      ch[10].b[15]=on; /* out of auto for history and reset in history also when mbdng */
  if (tim[5].status)
  { unsigned int newtime,a,h,l;
   #if !defined(TURBO)
   dm[71]= *(ptrstack);
   for ( ; (*(ptrstack) >= (ck_stack+STACK_SIZE) ); ) ; /* test stack for overflow, if so wait for
watchdog*/
   #endif
   get_time();
   save_history();
   newtime=1000*((tm.heur & 0xF0) >> 4) + 100*(tm.heur & 0x0F) \
              +10*((tm.min & 0xF0) >> 4)  + (tm.min & 0x0F);
   a=locate_his( dm[28]);
    /* not for manual operation take reading only if 103,102 or every 4+hr913 minutes*/
    if (newtime>=ptrhis[a].reading)
      h=newtime,l=ptrhis[a].reading;
   else
      l=newtime,h=ptrhis[a].reading;
    if ( ! ch[10].b[15] )
   { if (hr[1].b[3])
              l+=dm[92];
     else
              l+=dm[93];   }
  if(h>l) /* get new reading for history record */
   {  get_history();
     /* if in1 and 903 are off no next reading is required or if  in1 and 903 are both on no reading is
required same for 5 */       if (ch[9].b[3]==IN_1 && ch[9].b[4]==IN_5)                ch[10].b[15]=off;
     ch[9].b[3] = ch[9].b[4] = off;
/*******************************************
     difu(ptrch,9,3,IN_5);
     difd(ptrch,9,4,IN_5);
     corrented  with 8.11 to output if a change only once a minute
     if ( !ch[18].b[15] &&(ch[10].b[14] || ch[10].b[13] || ch[9].b[3] || ch[9].b[4]))
************************/
} }
/* HOUSE KEEPING OF ALL TIMERS, COUNTERS, AND BITS */
adjust_timers();
ch[18].b[15]=0; /* set first scan off */
/* ********* END OF HOUSE KEEPING ***************** */
}  /* do loop while true */
}  /* **** END OF MAIN ************************* */

"DM",0,"SPEED (SCANS)",
"DM",1,"REQUIRED SPEED",
"DM",2,"RPM (TIME)",
"DM",3,"TOTAL TURNS/COMPLETE CYCLE",
"DM",4,"OK TURNS",
"DM",5,"MODE (ETAPE)",
"DM",6,"TURNS (GLOBAL)",
"DM",7,"GLOBAL * 10000",
"DM",8,"METER IN DRUM",
"DM",9,"METERS LEFT IN DRUM",
"DM",10,"WATER ADDED ( LITRES )",
"DM",11,"VARIABLE VALVE TIMING",
"DM",12,"MAX VALUE DM 11",
"DM",13,"OLD TURNS SAVE (OOPS)",
"DM",14,"REQUIRED ""OK"" TURNS",
```

```
"DM",15,"LAST MODE ""OOPS""",
"DM",16,"ADJUST COUNTS",
"DM",17,"PULSE FOR HISTORY R.P.M.",
"DM",18,"PULSE (SCAN COUNT)",
"DM",19,"OLD MODE COMPARE",
"DM",20,"MATH",
"DM",21,"RAISE CONCRETE PULSES",
"DM",22,"PASSWORK MULTIPLE",
"DM",23,"SETUP HR 910,912,915",
"DM",24,"LOAD NUMBER 1-255",
"DM",25,"EMUL OF DRUM",
"DM",26,"SCANS/MIN",
"DM",27,"SCANS COUNT PER MIN (TIM2)",
"DM",28,"HISTORY OUTPUT NUMBER",
"DM",29,"% STANDARD TURNS REQUIRED",
"DM",30,"REQUIRED SCREEN VALUE",
"DM",31,"R.P.M. (TIME) COUNTS",
"DM",32,"TURN COUNTS FOR DM3",
"DM",33,"DUMP TO THROAT COUNTS",
"DM",34,"COUNT FOR ""OK"" TURNS",
"DM",35,"COUNT FOR EMPTYING TURNS",
"DM",36,"SPEED L1",
"DM",37,"SPEED L2",
"DM",38,"SPEED H1",
"DM",39,"SPEED H2",
"DM",40,"CALCULATE MAX PULSE COUNT",
"DM",41,"1365 OR RESET",
"DM",42,"TURNS MODE 2",30
"DM",43,"TURNS MODE 3",40
"DM",44,"TURNS MODE 4",0
"DM",45,"TURNS MODE 5",36
"DM",46,"TRUCK # 0-FFFF",
"DM",47,"TIME/LITRE (10= 1 SEC)",25
"DM",48,"WATER/CM (230=2.3 L)",590
"DM",49,"% CHANGE FOR SPEED",800
"DM",50,"DRUM VOLUME",9
"DM",51,"SPEED MODE 1",140
"DM",52,"SPEED MODE 2",128
"DM",53,"SPEED MODE 3",88
"DM",54,"SPEED MODE 4 (0=NO MODE)",0
"DM",55,"SPEED MODE 5",130
"DM",56,"SPEED MODE 6",15
"DM",57,"SPEED MODE 7",15
"DM",58,"COUNT REQ. FOR READING",39
"DM",59,"MINUMUM SCAN TIME",2
"DM",60,"DISCHARGE PULSE/M**3",52
"DM",61,"PULSE TO RAISE CEMENT",40
"DM",62,"PULSE / ROTATION",24
"DM",63,"MINIMUM SPEED FOR MIXING",60
"DM",64,"INTERRUPT TIMERS",
"DM",65,"INTERRUPT SPEED",
"DM",66,"KEYBOARD",
"DM",67,"KEYBOARD",
"DM",68,"KEYBOARD",
"DM",69,"PRINT OFFSET",
"DM",70,"EMUL",
"DM",71,"STACK POINTER",
"DM",72,"EMUL OUTPUT",
"DM",73,"ENGINE RPM",
"DM",74,"WATCHDOGS",
"DM",75,"BATTERY LEVEL READ",
"DM",76,"BATTERY LEVEL REQ.",
"DM",77,"LOW STOP BITS",160
```

```
"DM",78,"HIGH STOP BITS",175
"DM",79, max hr103 stroke value and dm[0]=0
"DM",80,"TOY",
"DM",81,"TOY",
"DM",82,"TOY",
"DM",83,"TOY",
"DM",84,"GET SECS",
"DM",85,"LITRES OF H20 ADDED",
"DM",86,"LITRE DISCHARGE/TURN",
"DM",87,"READINGS SINCE DOWNLOAD",
"DM",88,"TIME FOR TIM30 OUTPUT TO PRINT",
"DM",89,"BAUD RATE (4800)",
"DM",90,"PROGRAM NUMBER",
"DM",91,"DELAY FOR REMOTE CONSOLE",
"DM",92,"MIN TIME DELAY WHEN AUTOMATIC",
"DM",93,"MIN TIME DELAY WHEN NOT AUTO",
"DM",94,"TIM TO END MIX (EG 300=3 X )",
"DM",95,"REAR CHAR VALUE FROM CONSOLE",
"DM",96,,water_added
"DM",97,,water_time
dm  98 divisor value for pressure and gearbox not standard is 140 187 for 1-5 volts

"DM",99  Output for adc 0 from front analog switch
dm  100 TOTAL METERS COMPUMIXED
dm  101
dm  102
dm  103
dm  104
dm  105
dm  106
dm  106
dm  108
dm  109
DM  110 USED FOR HISTORY
DM  111 USED FOR HISTORY
DM  112 USED FOR HISTORY
DM  113 USED FOR HISTORY
DM  114 USED FOR HISTORY
DM  115 USED FOR HISTORY
DM  116 USED FOR HISTORY
DM  117 USED FOR HISTORY
DM  118 USED FOR HISTORY
DM  119 USED FOR HISTORY
DM  120 TIME FOR RPM READING
DM  121 OLD TIME FOR RPM READING
DM  122 SBAR
dm  123 sbar zero readings
dm  124 output to screen with negative value
dm  125 pressure reading adjusted for gearbox and pump assuming 5000/255 and 140
dm  126 slump reading
dm  127
dm  128 use presently in p1234 for slump pressure when hr 713 is on (emul)
```

TABLE 2

| DATA (DM) MEMORY | DEFINITION | DEFAULT VALUE |
|---|---|---|
| 0 | ACTUAL SPEED | CALCULATED |
| 1 | REQUESTED DRUM SPEED | VARIABLE |
| 2 | SPEED AVERAGE OVER 5 SECONDS | CALCULATED |
| 3 | TOTAL TURNS COMPLETE IN ACTUAL CYCLE | |
| 4 | TURNS AT OR ABOVE MIXING SPEED | |
| 6-7 | GRAND TOTAL OF MIXER REVOLUTIONS | |
| 8 | METERS LOADED IN DRUM | ENTERED |
| 9 | METERS LEFT IN DRUM | CALCULATED |
| 10 | WATERED ADDED IN CYCLE | CALCULATED |
| 11 | ADJUSTMENT TIME VARIABLE | LEARNED |
| 28 | HISTORY REFERENCE POINT | CALCULATED |
| 29 | MEMORY BANK NUMBER | CALCULATED |
| 31 | R.P.M (PULSE/TIME) | CALCULATED |
| 32 | COUNTS FOR DM3 | CALCULATED |
| 33 | COUNTS TO RAISE CEMENT TO THROAT OF MIXER DRUM | CALCULATED |
| 34 | COUNTS AT ACCEPTABLE SPEED | CALCULATED |
| 35 | COUNTS WHEN EMPTYING DRUM | CALCULATED |
| 40 | MAXIMUM TIME BEFORE AN AUTOMATIC READING IS USED | APPROXIMATED SPEED CALCULATED |
| 41 | DETERMINATION OF INITIAL STARTUP | 0X0555 |
| 42 | TURNS REQUIRED IN MODE 2 (HIGH SPEED MIX) | 30 |
| 43 | TURNS REQUIRED IN MODE 3 (LOW SPEED MIX) | 40 |
| 44 | TURNS REQUIRED IN MODE 4 | 0 |
| 45 | TURNS REQUIRED IN MODE 5 (REMIX) | 36 |
| 47 | TIME FOR 1 LITRE ADDITION OF WATER | 25 |
| 48 | WATER/IN CHANGE IN SLUMP | 590 |
| 49 | % ERROR IN ACTUAL SPEED | 800 |
| 50 | DRUM TOTAL VOLUME | 9 |
| 51 | SPEED REQUESTED FOR MODE 1 | 140 |
| 52 | SPEED REQUESTED FOR MODE 2 | 128 |
| 53 | SPEED REQUESTED FOR MODE 3 | 88 |
| 54 | SPEED REQUESTED FOR MODE 4 | 0 |
| 55 | SPEED REQUESTED FOR MODE 5 | 130 |
| 56 | SPEED REQUESTED FOR MODE 6 | 15 |
| 57 | SPEED REQUESTED FOR MODE 7 | 15 |
| 58 | MIN. TIME BEFORE READING ACCEPTED | 990 |
| 59 | MIN. NUMBER OF SCANS TO ADJUST STROKE OF PUMP | 2 |
| 60 | APPROX NUMBER OF COUNTS /METER DISCHARGED CALCULATED AS (D50-D9)/D50*2*D62+D62 | CALCULATED |
| 61 | PULSES TO RAISE CONCRETE | 40 |
| 62 | COUNTS (PULSES) PER REVOLUTION OF THE DRUM | 24 |
| 63 | MINIMUM SPEED TO BE CONSIDERED AS MIXING | 60 |

The embodiments of the invention in which an exclusive property or privilege is claimed are defined as follows:

1. A mobile concrete mixer for operation by a driver-operator comprising:

(1) a vehicle provided with a vehicle engine and engine throttle;

(2) a spirally-finned, rotatable mixing drum having a discharge end mounted on such vehicle;

(3) a drum motor means operatively coupled to the drum to rotate the drum in either the mixing or discharge directions;

(4) drum rotation detection means positioned to generate a signal corresponding to the rotation of the drum and the direction of rotation of the drum;

(5) a driver-operated drum control switch to cause the drum motor means to rotate the drum in the mixing or discharged directions, or stop the drum rotation, characterized by a programmed controller for automatically advancing the rotation of the drum in the mixing direction through the stages of a predetermined drum rotation regime that includes at least a higher speed stage for effecting mixing and a lower speed stage for effecting agitation while permitting interruption of such process by an operator, wherein said controller, beyond a limited period of time or amount of rotation in the mixing direction, always controls the rotational speed of the drum in the mixing direction.

2. A concrete mixer as in claim 1 wherein the improvement comprises a mixing regime for said controller that includes a mixing stage and an agitation stage, the controller being programmed to prevent rotation of the drum in the discharge direction for more than a limited amount before the drum has completed the mixing stage.

3. A concrete mixer as in claim 1 wherein the controller may be reprogrammed to vary the mixing regime.

4. A mixer as in claim 1 wherein the mixing regime provides for maximizing the entrainment of air within the load of concrete by:

(1) mixing the concrete initially at a first, elevated mixing speed which causes a substantial quantity of air to become entrained in such concrete; and (2) continuing the mixing of the concrete to a conclusion at a second, reduced mixing speed which minimizes the extent to which previously entrained air is released from the concrete.

5. A concrete mixer as in claim 1 wherein the vehicle engine 5 provides power to the drum motor means and the speed of rotation of the drum, when turning in the mixing regime, is maintained substantially at a pre-determined level by the controller, such speed of rotation being independent of vehicle engine speed.

6. A concrete mixer as in claim 1 wherein the mixing regime adopted by the controller follows a predetermined re-mixing cycle, once a signal has been given to the controller that additional water or ingredients have been added to the drum and the drum commences to rotate in the mixing direction for more than a predetermined number of turns.

7. In a concrete mixer comprising:

(1) a vehicle provided with a vehicle engine;

(2) a spirally-finned, rotatable mixing drum having a discharge end mounted on such vehicle;

(3) a drum motor means operatively coupled to the drum to rotate the drum in either the mixing or discharge directions;

(4) drum rotation detection means positioned to generate a signal corresponding to the rotation of the drum and the direction of rotation of the drum;

(5) a driver-operated drum control switch to cause the drum motor means to rotate the drum in the mixing or discharged directions, or to stop the drum rotation, (6) a programmed controller for automatically advancing the rotation of the drum through the stages of a predetermined drum rotation regime that includes at least one mixing stage and an agitation stage while permitting interruption of such process by an operator, wherein said controller is programmed to provide that, once mixing has commenced and until mixing has been completed, the driver can operate the drum to turn in the discharge direction, but only for a predetermined limited amount short of the commencement of discharge.

8. A concrete mixer as in claim 6 wherein the remixing regime that is followed by the controller upon the addition of further ingredients may be manually interruptible to the extent that drum rotation may be stopped, but not to the extent of permitting the drum to rotate in the discharge direction for more than a limited number of permitted turns, or partial turns, before remixing is complete.

9. A mixer as in claim 6 wherein the number of mixing turns in the remixing cycle is determined by the controller in accordance with the volume of concrete contained within the drum.

10. A concrete mixer as in claim 1 wherein said drum motor means is hydraulically operated and further comprising:

(1) an hydraulic pump driven by the vehicle engine and connected to provide pressurized hydraulic fluid to the drum motor means;

(2) hydraulic control means for varying the flow of the hydraulic fluid through the drum motor means and thereby to cause rotation of the drum in either the mixing or discharge directions;

(3) hydraulic pressure detection means; and (4) display means for indicating to an operator the slump condition of concrete contained within the drum, the display of such display means being generated by the controller by a comparison of the measure of the hydraulic pressure produced by the hydraulic pressure detection means with a previously calibrated schedule of slump as a function of hydraulic pressure while the concrete is being mixed at below 6 rpm, or preferably at between 1½ to 2 rpm.

11. A concrete mixer as in claim 10 wherein the said schedule is calibrated for varying loads of concrete, and the mixer further comprises load determining means for establishing the actual load of concrete carried by the mixer and the display of the slump condition of the concrete generated by the controller corresponds to the actual load of concrete carried by the mixer.

12. A concrete mixer as in claim 11 wherein said load determining means comprises a recording means for receiving an input that indicates the initial load of concrete placed in the drum, discharge measuring means that detects the quantity of concrete that has been discharged from the drum, and comparator means that indicates the actual load of concrete carried by the mixer by subtracting the value of the discharged quantity of concrete from the value for the initial load of concrete.

13. A concrete mixer as in claims 12 characterized in that the water reservoir is provided with water flow detection means and the controller is characterized by a water-record storage means to record the history of water flow from the reservoir.

14. A concrete mixer as in claim 11 wherein the drum is supported at its rearward end on roller bearing means, and at its forward end on a pedestal mounted on said vehicle, and said load determining means comprises a weight detector that measures the load applied by the drum at its forward end to the pedestal.

15. A concrete mixer as in claim 10 comprising an engine throttle wherein the controller automatically adjusts the engine throttle to operate the engine at the minimum speed necessary to provide the required hydraulic pressure to operate the drum motor means.

16. A concrete mixer as in claim 9, 10, 11, 12, 14 or 15 characterized in that the re-mixing cycle that is followed by the controller may be manually interrupted by the operator to the extent that drum rotation may be stopped, and rotated in the discharge direction, but only to a limited extent short of effecting discharge, before re-mixing is complete.

17. A mixer as in claim 8, 9, 10, 11, 12, 14, or 15 characterized by the controller being programmed to determined the number of mixing turns in the re-mixing cycle in accordance with the quantity of the load of concrete contained within the drum.

18. A mixer as in claim 1 characterized by a load determining means that is coupled to the controller to provide the controller with a signal corresponding to the quantity of the load of concrete contained within the drum.

19. A concrete mixer as in claim 18, wherein the controller is characterized by storage means to record the history of the quantity of load of the concrete present in the drum.

20. A concrete mixer as in claim 1 wherein said drum motor means is hydraulically operated to operate at a pre-selected, controlled drum speed which is independent of the vehicle engine speed and further comprising:

(1) an hydraulic pump driven by the vehicle engine and connected to provide pressurized hydraulic fluid to the drum motor means;

(2) hydraulic control means for varying the flow of the hydraulic fluid through the drum motor means, including causing rotation of the drum in either the mixing or discharge directions;

(3) hydraulic pressure detection means; and (4) display means for indicating to an operator the slump condition of concrete 23 contained within the drum 2;

wherein, the display of such display means is generated by the controller by a comparison of the measure of the average hydraulic pressure produced by the hydraulic pressure detection means over at least the interval, or successive intervals, between the passage of consecutive spiral fins within the drum, with a previously calibrated schedule of slump as a function of hydraulic pressure established at said pre-selected, controlled drum speed.

21. A concrete mixer as in claim 20 characterized in that said controlled drum speed is below 6 rpm.

22. A concrete mixer as in claim 21 characterized in that the indication of slump condition is effected while the concrete is being agitated at between 1½ to 2 rpm.

23. A concrete mixer as in claims 20, 21 or 22 wherein the said schedule is calibrated for varying loads of concrete, and the mixer is further characterized by load determining means for establishing the actual load of concrete carried by the mixer, the display of the slump condition of the concrete being generated by the controller in correspondence to the actual load of concrete carried by the mixer.

24. A concrete mixer as in claim 23 wherein the drum is supported at a first discharge end on roller bearing means, and at its opposite end on a pedestal mounted on said vehicle, and said load determining means comprises a single weight detector associated with said pedestal, characterized in that said load determining means determines the load applied by the drum at its forward end to the pedestal when the drum is turning in the mixing direction at a pre-selected, controlled speed.

25. A concrete mixer as in claims 24 wherein the controller is characterized by storage means to record the history of the quantity of concrete present in the drum.

26. A concrete mixer as in claim 23 characterized in that said load determining means comprises:

(a) a recording means for receiving an input that indicates the initial load of concrete placed in the drum, (b) discharge measuring means that detects the quantity of concrete that has been discharged from the drum, and (c) comparator means that indicates the actual load of concrete carried by the mixer by subtracting the value of the discharged quantity of concrete from the value for the initial load of concrete.

27. A concrete mixer as in claim 26 characterized in that said comparator means determines the actual load of concrete carried by the mixer by applying the following formula:

$$\text{Load}=\text{Original Load}\times[1-\text{Discharge Rate/Turn}\times(\text{number of discharge Turns}-\text{"N"})]$$

wherein the "Discharge Rate/Turn" is the rate at which the drum delivers concrete, once discharge has commenced, and "N" is the number of turns necessary in order for the drum to commence discharge.

28. A concrete mixer as in claims 27 wherein the controller is characterized by storage means to record the history of the quantity of concrete present in the drum.

29. A concrete mixer as in claim 26 characterized in that the circumferentially spaced markers are bolt-heads that are attached to the drum.

30. A concrete mixer as in claims 26 wherein the controller is characterized by storage means to record the history of the quantity of concrete present in the drum.

31. A concrete mixer as in claim 23 characterized by further comprising display means coupled to said load determining means for displaying the actual load of concrete remaining in the mixer drum.

32. A concrete mixer as in claim 23 wherein the controller is characterized by storage means to record the history of the slump condition of the concrete present in the drum.

33. A concrete mixer as in claims 23 wherein the controller is characterized by storage means to record the history of the quantity of concrete present in the drum.

34. A concrete mixer as in claims 20, 21 or 22 wherein the controller is characterized by storage means to record the history of the slump condition of the concrete present in the drum.

35. A concrete mixer as in claims 1, 20, 21 or 22 comprising:

(1) a water reservoir with a hose for delivery of water;

(2) a water flow detector that provides a signal indicating the quantity of water flowing from the reservoir;

(3) display means connected to said water flow detector, wherein, upon receipt of a signal from said water flow detector of the quantity of water flowing from the reservoir, said display means indicates the projected change in slump arising from the addition of such water.

36. A concrete mixer as in claim 35 characterized in that said display means indicates the projected change in slump arising from the addition of such water in accordance with the load of concrete remaining in the mixing drum.

37. A concrete mixer as in claim 36 characterized in that the water reservoir is provided with water flow detection means and the controller is characterized by a water-record storage means to record the history of water flow from the reservoir.

38. A concrete mixer as in claim 35 characterized in that the water reservoir is provided with water flow detection means and the controller is characterized by a water-record storage means to record the history of water flow from the reservoir.

39. A concrete mixer as in claim 1 wherein the said drum rotation detection means is characterized by:

(1) a plurality of circumferentially spaced markers positioned on the drum;

(2) a rotational pickup attached to the vehicle and positioned to detect passage of the markers during rotation of the drum.

40. A concrete mixer as in claim 39 characterized in that the controller is programmed to determine the rotational speed of the drum by evaluating the momentary drum rotation speed values determined from the passage of successive pairs of markers past the pickup, and averaging such successive speed values to determine such drum rotational speed.

41. A concrete mixer as in claim 40 wherein the controller is characterized by storage means to record the rotational history of the drum derived from the drum rotation detection means.

42. A concrete mixer as in claim 1 characterized in that the controller may only be reprogrammed by persons other than the driver-operator to vary the mixing regime.

43. A concrete mixer as in claim 1 wherein the controller is characterized by storage means to record the rotational history of the drum derived from the drum rotation detection means.

44. A concrete mixer as in claim 1 comprising:

(a) an hydraulic pump driven by the vehicle engine 5 and connected to provide pressurized hydraulic fluid to the drum motor means;

(b) hydraulic control means for varying the flow of the hydraulic fluid through the drum motor means, including causing rotation of the drum in either the mixing or discharge directions; and (c) an engine starter, characterized in that the controller is programed to automatically adjust the hydraulic control means to reduce the flow of hydraulic fluid to the drum motor means to zero when the engine starter is engaged.

45. A concrete mixer as in claim 1 characterized in that the controller is programmed to effect the mixing stage of the drum rotation regime 27 for maximizing the entrainment of air within the load of concrete by:

(1) mixing the concrete initially at a first, elevated mixing speed which causes a substantial quantity of air to become entrained in such concrete; and (2) continuing the mixing of the concrete to a conclusion at a second, reduced mixing speed which minimizes the extent to which previously entrained air is released from the concrete.

46. A concrete mixer as in claim 45 wherein the first elevated mixing speed is substantially in the range of 11–12 rpm.

47. A concrete mixer as in claims 45 or 46 wherein the second, reduced mixing speed is substantially in the range of 6–8 rpm.

48. A concrete mixer as in claim 1 wherein the vehicle engine provides power to the drum motor means through an hydraulic pump and the speed of rotation of the drum is maintained substantially at a pre-determined level by the controller, characterized in that the controller, while the mixer vehicle is stationary, is programmed to adjust the engine throttle to minimize the vehicle engine speed and maintain the speed of rotation of the drum initially kept substantially independent of vehicle engine speed by controlling the hydraulic pump, up to the limit of its capacity, and thereafter by increasing the vehicle engine speed if a higher drum speed is required.

49. In a concrete mixer as in claim 1 comprising an hydraulic pump driven by the vehicle engine and connected to provide hydraulic fluid to the drum motor means, the method of controlling the drum speed while the mixer vehicle is stationary by principally controlling the volume of hydraulic fluid produced by the hydraulic pump, to the limit of its capacity, and thereafter controlling the engine throttle to operate the vehicle engine at the minimum speed necessary to provide the required hydraulic pressure to operate the drum motor means at the desired drum speed.

50. A concrete mixer as in claims 1, 2, 3, 4, 5, 6 or 7 comprising a water reservoir provided with water flow detection means wherein the controller is provided with a water-record storage means to record the history of water flow from the reservoir as provided by the water flow detection means.

51. A method of mixing concrete to maximize the entrainment of air characterized by:

(1) mixing the concrete initially at a first, elevated mixing speed, in the range of 11–12 rpm, which causes a substantial quantity of air to become entrained in such concrete; and (2) continuing the mixing of the concrete to a conclusion at a second, reduced mixing speed, in the range of 6–8 rpm, which minimizes the extent to which previously entrained air is released from the concrete.

* * * * *